US007306309B2

(12) United States Patent
Kuwahara et al.

(10) Patent No.: US 7,306,309 B2
(45) Date of Patent: Dec. 11, 2007

(54) LIQUID DISCHARGE APPARATUS AND METHOD FOR DISCHARGING LIQUID

(75) Inventors: Soichi Kuwahara, Kanagawa (JP); Kazuyasu Takenaka, Tokyo (JP); Iwao Ushinohama, Kanagawa (JP); Yuichiro Ikemoto, Kanagawa (JP)

(73) Assignee: Sony Corporation (JP)

( * ) Notice: Subject to any disclaimer, the term of this patent is extended or adjusted under 35 U.S.C. 154(b) by 170 days.

(21) Appl. No.: 10/784,288

(22) Filed: Feb. 24, 2004

(65) Prior Publication Data

US 2004/0223013 A1 Nov. 11, 2004

(30) Foreign Application Priority Data

Feb. 27, 2003 (JP) ..... P2003-050745
Jun. 11, 2003 (JP) ..... P2003-167081

(51) Int. Cl.
*B41J 29/38* (2006.01)

(52) U.S. Cl. ..... 347/9; 347/77; 347/62

(58) Field of Classification Search ..... 347/9
See application file for complete search history.

(56) References Cited

U.S. PATENT DOCUMENTS

| | | | | |
|---|---|---|---|---|
| 4,551,731 | A | 11/1985 | Lewis et al. | |
| 5,172,139 | A | 12/1992 | Sekiya et al. | |
| 5,754,201 | A * | 5/1998 | Ishinaga et al. | 347/62 |
| 2002/0021324 | A1 * | 2/2002 | Yamada et al. | 347/42 |

FOREIGN PATENT DOCUMENTS

| | | |
|---|---|---|
| EP | 0 481 797 | 4/1992 |
| EP | 0 755 790 A1 | 1/1997 |
| EP | 1 110 732 A2 | 6/2001 |
| EP | 1 167 038 | 1/2002 |
| EP | 1 201 435 A2 | 5/2002 |
| EP | 1 219 427 | 7/2002 |
| EP | 1 167 038 B1 | 8/2003 |
| JP | 2002-036522 | 2/2002 |
| JP | 2002-240287 | 8/2002 |

OTHER PUBLICATIONS

Singapore Search Report Nov. 9, 2005.
Singapore Written Opinion dated Nov. 9, 2005.
EPO Search Report dated Jul. 13, 2005.
EPO Search Report dated Mar. 15, 2005.
Singapore Search Report, Application No. SG 200401612-7, dated Feb. 25, 2004.

* cited by examiner

*Primary Examiner*—Matthew Luu
*Assistant Examiner*—Brian J. Goldberg
(74) *Attorney, Agent, or Firm*—Rader Fishman & Grauer PLLC; Ronald P. Kananen

(57) ABSTRACT

A liquid discharge apparatus having heads with liquid dischargers including nozzles aligned in parallel in a row. Each liquid discharger has a main controlling unit for discharging ink droplets from the nozzles of the liquid discharger, a secondary controlling unit for controlling the discharge of a droplet so that the droplet is discharged along at least one trajectory different from the trajectories of the droplets discharged from a liquid discharger controlled by the main controlling unit, and a secondary-control executing unit for individually setting whether or not the secondary controlling unit for each liquid discharger is operated. The liquid dischargers controlled by the secondary controlling unit discharge ink droplets along different trajectories compared to the ink droplets discharged by other liquid dischargers.

21 Claims, 23 Drawing Sheets

FIG. 22A

| STATE OF THE SWITCHES | | | | LANDING POSITION OF DOTS | | | | | | | |
|---|---|---|---|---|---|---|---|---|---|---|---|
| Dpx | D6 | D5 | D4 | −3 | −2 | −1 | 0 | +1 | +2 | +3 | |
| 0 | 0 | 0 | 0 | | | | ● | | | | |
| | | 1 | | | | ● | | | | | |
| | 1 | 0 | | | ● | | | | | | |
| | | 1 | | ● | | | | | | | |
| 1 | 0 | 0 | | | | | ● | | | | |
| | | 1 | | | | | | ● | | | |
| | 1 | 0 | | | | | | | ● | | |
| | | 1 | | | | | | | | ● | |

FIG. 22B

| STATE OF THE SWITCHES | | | | LANDING POSITION OF DOTS | | | | | | | |
|---|---|---|---|---|---|---|---|---|---|---|---|
| Dpx | D6 | D5 | D4 | 0 | 1 | 2 | 3 | 4 | 5 | 6 | 7 |
| 0 | 1 | 1 | 1 | ● | | | | | | | |
| | | 0 | | | ● | | | | | | |
| | 0 | 1 | | | | ● | | | | | |
| | | 0 | | | | | ● | | | | |
| 1 | 0 | 0 | | | | | | ● | | | |
| | | 1 | | | | | | | ● | | |
| | 1 | 0 | | | | | | | | ● | |
| | | 1 | | | | | | | | | ● |

LIQUID DISCHARGE APPARATUS AND METHOD FOR DISCHARGING LIQUID

BACKGROUND OF THE INVENTION

1. Field of the Invention

The present invention is related to a liquid discharge apparatus including a plurality of heads having liquid dischargers with nozzles aligned in parallel in a row and a method for discharging liquid by using a plurality of heads having liquid dischargers with nozzles aligned in parallel in a row. More specifically, the invention relates to a technology for individually setting the trajectories of droplets for each liquid discharger and enabling each liquid discharger to discharge droplets in appropriate directions.

2. Description of the Related Art

One type of known liquid discharger is an inkjet printer. There are two types of known inkjet printers: 1) a serial printer in which a head is moved in the width direction of a recording medium while discharging droplets onto the recording medium as the recording medium moves in the feeding direction; 2) a line printer in which a line head is disposed across the width of a recording medium and only the recording medium is moved in the direction perpendicular to the width direction of the recording medium while droplets are discharged from the line head onto the recording medium (e.g., Japanese Unexamined Patent Application Publication No. 2002-36522).

When a line head is formed according to the above-mentioned known technology, the number of liquid dischargers becomes greater than those of the head of a serial printer. Therefore, for the line head, there is a problem in that the discharge characteristic of each liquid discharger varies greatly.

When the discharge characteristic of the liquid dischargers of a serial printer varies to a certain degree, dots can be overlapped to fill in space in dot rows already formed. In this way, the variation in the discharge characteristic can be minimized.

On the contrary, the head of a line printer does not move, and, therefore, once an area is recorded, it cannot be re-recorded by overlapping the dots. Thus, the line printer has a problem in that the characteristic of each liquid discharger varies in the alignment direction of the liquid dischargers, causing uneven streaks.

In other words, when the characteristic of each liquid discharger varies, this cannot be compensated for.

SUMMARY OF THE INVENTION

An object of the present invention is to compensate for the variation in the discharge characteristic of each liquid discharger and thereby to reduce the number of uneven streaks and improve the printing quality.

The present invention achieves the above-mentioned object by the following means.

A first aspect of the present invention is a liquid discharge apparatus having a head with a plurality of liquid dischargers including nozzles aligned in parallel in a row, comprising: a main controlling unit formed on each liquid discharger for controlling the discharge of droplets from the nozzles; a secondary controlling unit formed on each liquid discharger for controlling the discharge of a droplet so that the droplet is discharged along at least one trajectory different from the trajectories of the droplets discharged by the liquid dischargers controlled by the main controlling unit; and a secondary-control executing unit for individually setting whether or not the secondary controlling unit for each liquid discharger is operated.

In the first aspect of the present invention, a secondary-control executing unit individually sets whether or not the secondary controlling unit for each liquid discharger is operated. When the trajectory of the ink droplets discharged by a liquid discharger differs from the trajectories of the ink droplets discharged by other liquid dischargers, the secondary controlling unit is operated.

A second aspect of the present invention is a liquid discharge apparatus having a head with a plurality of liquid dischargers including nozzles aligned in parallel in a row, comprising: a discharge-direction changing unit for changing the trajectories of the droplets discharged from the nozzles of each liquid discharger in at least two different directions in the row; and a reference-direction setting unit for setting one of the trajectories of the droplets discharged from liquid dischargers controlled by the discharge-direction changing unit as a reference direction.

In the second aspect, each liquid discharger has a discharge-direction changing unit and can discharge ink droplets along at least two different directions in a row.

A reference trajectory is selected for each liquid discharger by the reference-direction setting unit.

A third aspect of the present invention is a liquid discharge apparatus having a head with a plurality of liquid dischargers including nozzles aligned in parallel in a row, comprising: a discharge-direction changing unit for changing the trajectories of the droplets discharged from the nozzles of each liquid discharger in at least two different directions in the row; and a discharge-angle setting unit for setting discharge angles for each droplet discharged from the liquid dischargers controlled by the discharge-direction changing unit for each liquid discharger.

In the third aspect, each liquid discharger has a discharge-direction changing unit and can discharge ink droplets along at least two different trajectories in a row.

The discharge angle of an ink droplet is set for each liquid discharger by the discharge-angle setting unit.

BRIEF DESCRIPTION OF THE DRAWINGS

FIGS. 22A and 22B are charts showing the change in the landing positions of dots in the nozzle alignment direction for the on and off states of a polarity changing switch and a first discharge controlling switch.

DESCRIPTION OF THE PREFERRED EMBODIMENTS

In the following, embodiments of the present invention are described with reference to the drawings. In this specification, the term 'droplet' refers to a minute amount (for example, several picoliters) of liquid discharged from a nozzle 18 of a liquid discharger described in the following. The term 'dot' refers to an ink droplet that has landed on a recording medium such as printing paper. The term 'pixel' refers to the minimum unit of an image. The term 'pixel area' refers to the area that forms a pixel.

In one pixel area, a predetermined number (i.e., none, one or more) of droplets land to form three types of pixels: a pixel formed of no dots (tone 1); a pixel formed of one dot (tone 2); or a pixel formed of a plurality of dots (tone 3 or more). In other words, one pixel area has zero dots, one dot, or a plurality of dots. The pixels are aligned on a recording medium to form an image.

The dot(s) that corresponds to a pixel does not always land inside the pixel area and may land outside the pixel area.

(Structure of Head)

Figure 1:
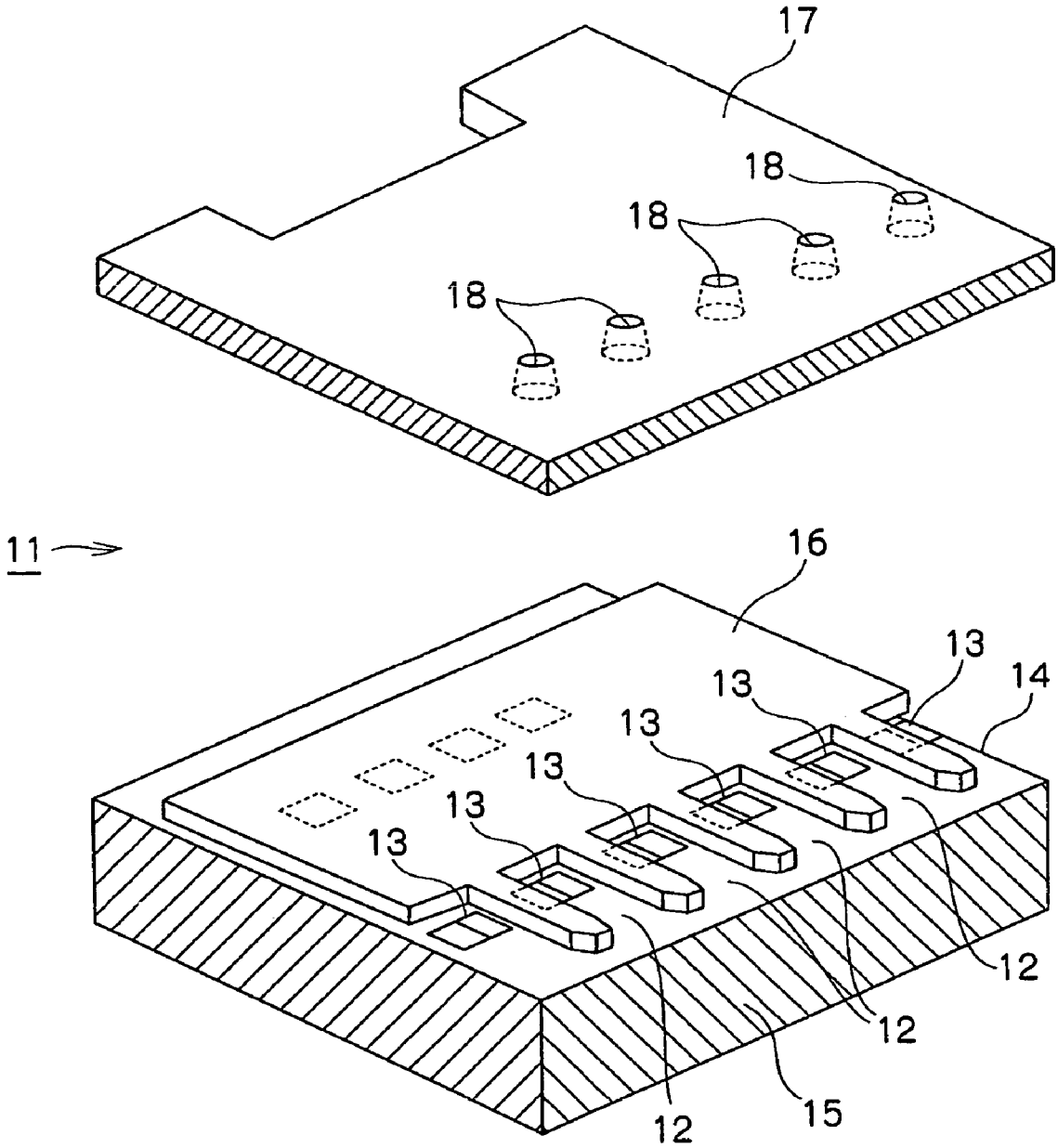
FIG. 1 is an exploded perspective view of an inkjet printer head having liquid dischargers according to the present invention.

FIG. 1 is an exploded perspective view of a head 11 of an inkjet printer (hereafter referred to as a 'printer') including a liquid discharge apparatus according to the present invention.

The head 11 illustrated in FIG. 1 includes a plurality of liquid dischargers aligned in parallel in a row. Each liquid discharger includes ink chambers 12 containing ink to be discharged, heat-generating-resistors 13 (which are equivalent to bubble generators or heating elements according to the present invention) disposed inside the ink chambers 12 and which generate bubbles in the liquid contained in the ink chambers 12 by supplying energy, and a nozzle sheet 17 with nozzles 18 (which are equivalent to nozzle forming material according to the present invention) for discharging the liquid contained in the ink chambers 12 when bubbles are generated by the heat-generating-resistors 13. More specifically, the head 11 is structured as described below.

In FIG. 1, although the nozzle sheet 17 is bonded onto a barrier layer 16, the nozzle sheet 17 is shown separated from the barrier layer 16.

A substrate 14 on the head 11 includes a silicon semiconductor substrate 15 and the heat-generating-resistors 13 formed by deposition on one surface of the semiconductor substrate 15. The heat-generating-resistors 13 are electrically connected to an external circuit via a conductor (not shown in the drawing) formed on the semiconductor substrate 15.

The barrier layer 16 is, for example, formed by stacking a photosensitive cyclic rubber resist or a photo-curable dry film resist on the entire surface provided with the heat-generating-resistors 13 of the semiconductor substrate 15 and then by removing unnecessary portions by a photolithography process.

The nozzle sheet 17 includes a plurality of nozzles 18 and is formed by, for example, electrotyping with nickel. The nozzle sheet 17 is disposed on the barrier layer 16 so that the locations of the nozzles 18 are aligned with the opposing heat-generating-resistors 13.

The ink chambers 12 are defined by the substrate 14, the barrier layer 16, and the nozzle sheet 17 surrounding the heat-generating-resistors 13. More specifically, as shown in the drawing, the substrate 14 functions as bottom walls of the ink chambers 12, the barrier layer 16 functions as sidewalls of the ink chambers 12, and the nozzle sheet 17 functions as upper walls of the ink chambers 12. In this way, the ink chambers 12 have openings in the front right surface shown in FIG. 1. These openings and an ink channel (not shown in the drawing) communicate with each other.

One of the heads 11 described above normally has ink chambers 12 and heat-generating-resistors 13, which are disposed in the respective ink chambers 12, of the order of several dozen to several hundred units. A printer controller commands each heat-generating-resistor 13. In this way, the ink contained in the ink chambers 12 corresponding to the controlled heat-generating-resistors 13 is discharged from the nozzles 18 opposing the ink chambers 12.

More specifically, the ink chambers 12 are filled with ink sent from an ink tank (not shown in the drawing) connected to the head 11. By applying a pulse current to the heat-generating-resistor 13 for a short time, e.g., for 1 to 3 μsec, the heat-generating-resistor 13 is rapidly heated. As a result, a gaseous ink bubble is formed where the ink comes into contact with the heat-generating-resistor 13. When the ink bubble expands, a predetermined amount of ink is emitted (or in other words, the ink boils). In this way, the same amount of ink as that emitted from the above-mentioned nozzle 18 is discharged from the nozzle 18 as an ink droplet. The droplet lands on printing paper to form a dot (i.e., a pixel).

Figure 2:
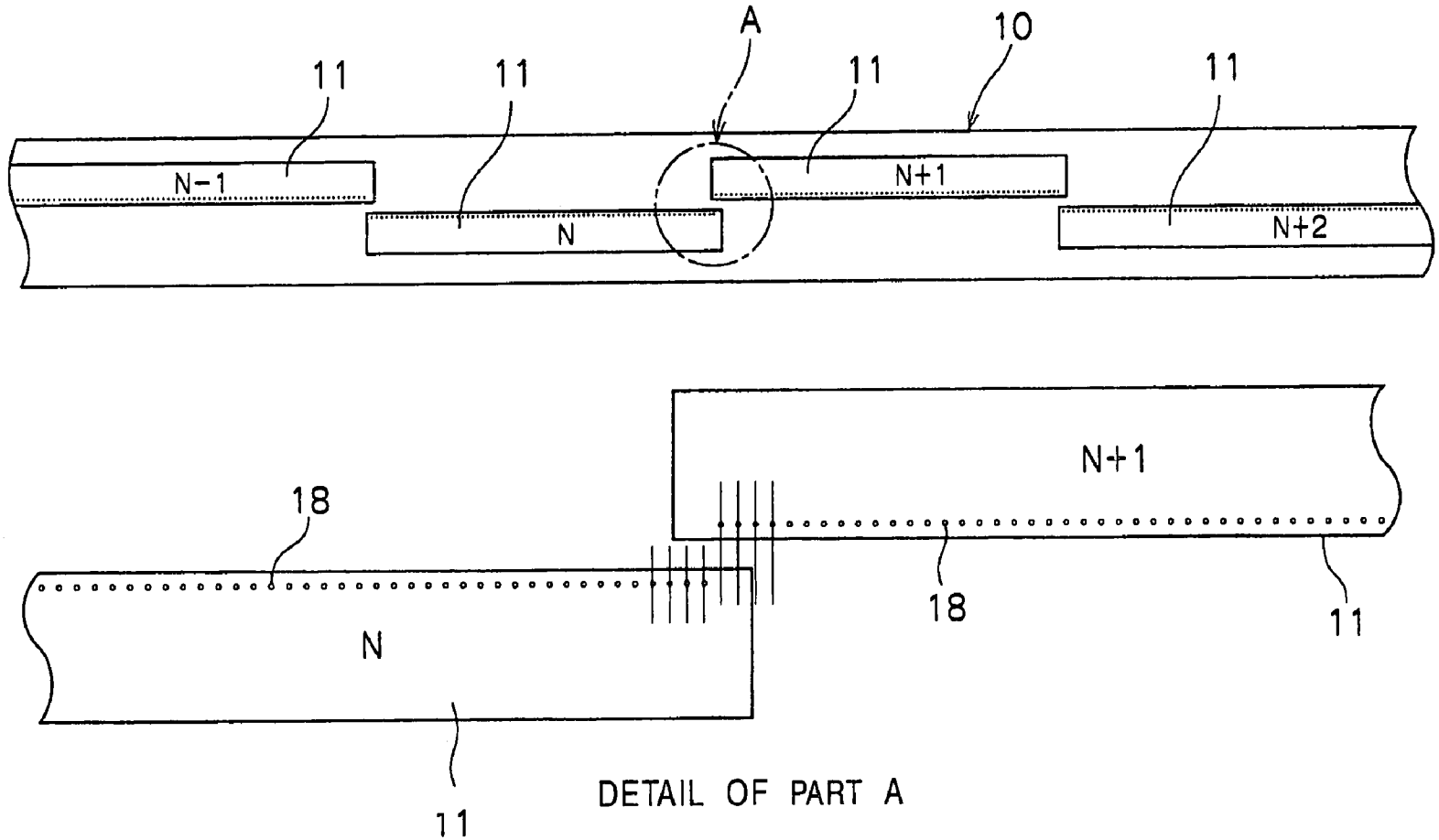
FIG. 2 is a plan view of a line head according to an embodiment of the present invention.

In this embodiment, the line head is formed by aligning a plurality of heads 11 in a row (along the alignment direction of the nozzles 18 or the width direction of the printing medium). FIG. 2 is a plan view illustrating an embodiment of a line head 10. FIG. 2 depicts four heads 11 (N−1, N, N+1, and N+2). To form the line head 10, the heads 11 excluding the nozzle sheets 17, which are known as head chips, are aligned in series.

Then, one nozzle sheet 17 with nozzles 18 formed in positions corresponding to liquid dischargers formed on each head chip is attached to the upper parts of the head chips to form the linehead 10.

Adjacent heads 11 are alternately (in a zigzag pattern) disposed on the nozzle sheet 17, on both sides of an ink channel that extends in a predetermined direction. The heads 11 on one side of the ink channel oppose the heads 11 on the other side of the ink channel so that their nozzles 18 oppose each other. More specifically, as shown in FIG. 2, an ink channel for the line head 10 is disposed between a line connecting edges adjacent to nozzles 18 of the N−1th and N+1th heads 11 with edges of adjacent to nozzles 18 of the Nth and N+2th heads 11.

As shown in the detailed drawing of part A included in FIG. 2, the heads 11 are aligned so that the pitches between the nozzles 18 on each side of the adjacent heads 11 are equal. In other words, the distance between one of the nozzles 18 at the right of the Nth head 11 and one of the nozzles 18 at the left of the N+1th head 11 is equal to the pitch between the nozzles 18.

(Discharge-direction changing unit, or main controlling unit and secondary controlling unit)

A head 11 has a discharge-direction changing unit, or a main controlling unit and a secondary controlling unit.

The discharge-direction changing unit according to this embodiment changes the trajectory of an ink droplet discharged from the nozzle 18 in at least two different directions in the row (along the alignment direction of nozzles 18).

More specifically, the discharge-direction changing unit includes a main controlling unit, which is formed on each liquid discharger, for controlling the nozzles 18 of the liquid discharger to discharge droplets and a secondary controlling unit, which is formed on each liquid discharger, for controlling the liquid discharger to discharge droplets along at least one trajectory in addition to the trajectory of the main controlling unit. The discharge-direction changing unit (main controlling unit and secondary controlling unit) according to the embodiment is structured as described in the following.

Figure 3A:
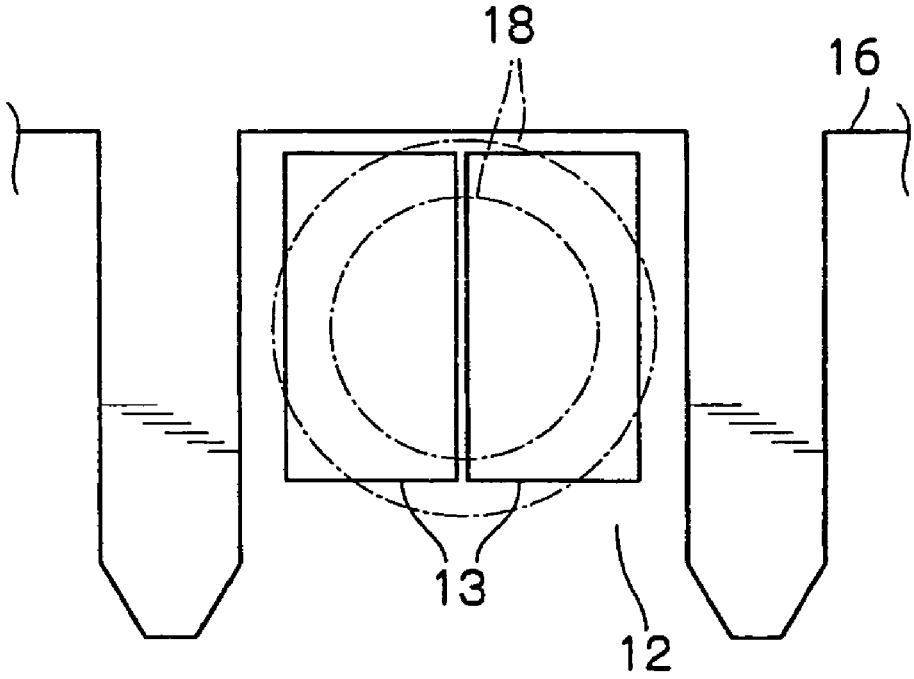
FIG. 3 consisting of FIGS. 3A and 3B, is a plan view and a sideward cross-sectional view illustrating heat-generating-resistors of the head in detail.
Figure 3B:
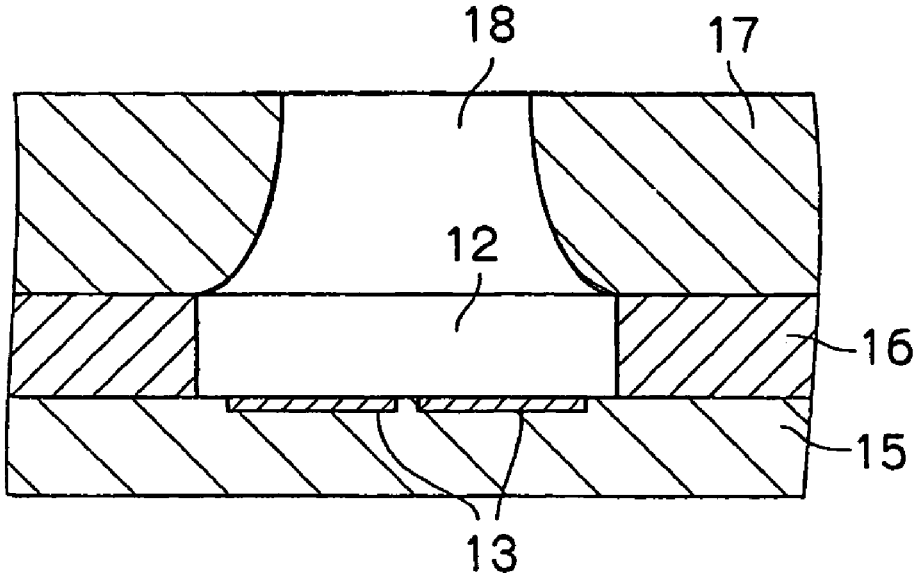

FIG. 3 is a plan view and a sideward cross-sectional view showing a liquid discharger of a head 11 in more detail. The dashed line in the plan view of FIG. 3 indicates a nozzle 18.

As shown in FIG. 3, one heat-generating-resistor 13 is contained in each ink chamber 12 of each head 11 according to this embodiment. The heat-generating-resistor 13 is composed of two parts arranged in parallel. The two parts of the heat-generating-resistor 13 are arranged in a row (which is the alignment direction of the nozzles 18, i.e., the left and right in FIG. 3).

When one heat-generating-resistor 13 is longitudinally divided into two parts, the length of each part remains the same but the width becomes half of the length of the undivided heat-generating-resistor 13. Therefore, the resistance of the divided heat-generating-resistor 13 is twice as large as the resistance of the undivided heat-generating-resistor 13. By serially connecting the two parts of the heat-generating-resistor 13, the resistance becomes four times as large as the undivided heat-generating-resistor 13 since the resistance of each part of the heat-generating-resistor 13 is twice as large as the undivided heat-generating-resistor 13.

To boil the ink contained inside the ink chamber 12, the heat-generating-resistor 13 must be heated by supplying a constant amount of electricity. The energy generated when the ink boils causes the ink to be discharged. If the resistance is small, a large amount of electricity is required. If the resistance of the heat-generating-resistor 13 is large, the ink can be boiled by supplying only a small amount of electricity.

In this way, the size of the transistor for supplying electricity can be reduced and space can be conserved. It is possible to increase the resistance by reducing the thickness of the heat-generating-resistor 13. The thickness, however, cannot be reduced to less than a predetermined thickness since there is a limit in the strength (durability) of the material selected for forming the heat-generating-resistor 13. Therefore, instead of reducing the thickness, the heat-generating-resistor 13 is divided into two parts to increase the resistance.

When the heat-generating-resistor 13 having two parts is contained in one of the ink chambers 12 and when each part is set to have the same bubble generation time, i.e., the time required for one of the parts of the heat-generating-resistor 13 to reach the ink boiling temperature, ink above both parts boils simultaneously and an ink droplet is discharged in a direction along the central axis of the nozzle 18.

On the contrary, when there is a difference in the bubble generation time of the two parts of the heat-generating-resistor 13, ink does not boil simultaneously above both parts. Thus, the trajectory of the ink droplet is shifted from the central axis of the nozzle 18. As a result, the trajectory of the ink droplet is deflected. In this way, the ink droplet lands in a position shifted from the landing position of an ink droplet discharged without a bubble generation time difference.

Figure 4B:
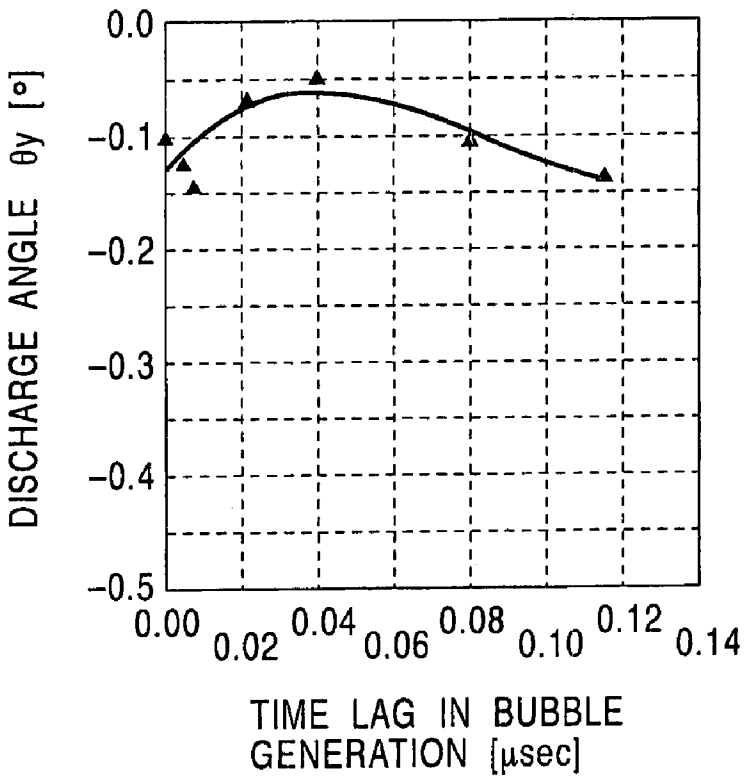
FIG. 4 consisting of FIGS. 4A, 4B, and 4C, is a graph indicating the relationship between the difference in the ink bubble generation time for each heat-generating-resistor and the discharge angle of an ink droplet.
Figure 4A:
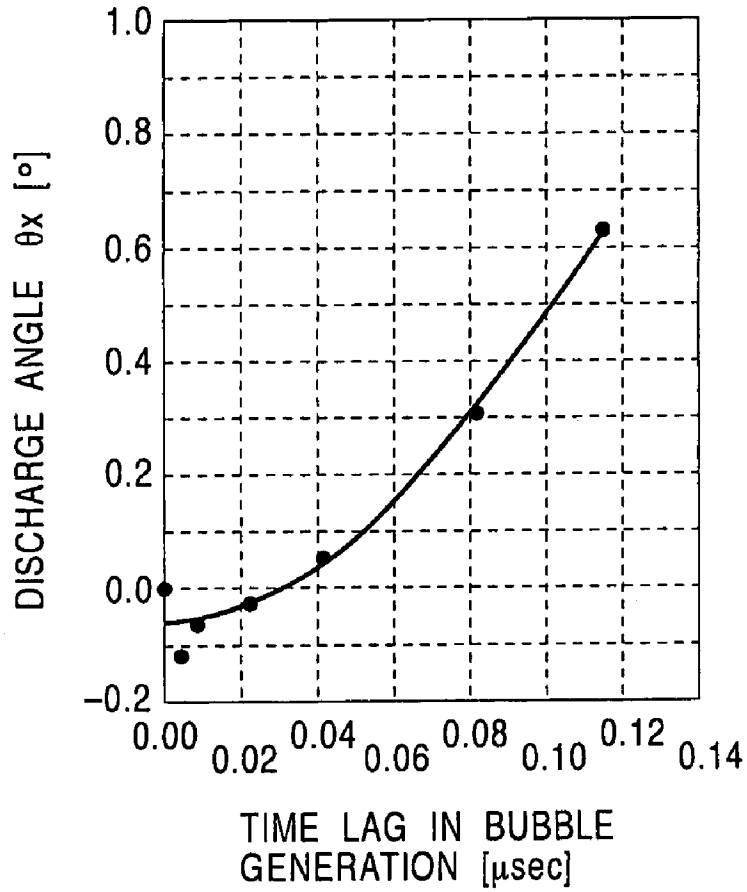

FIGS. 4A and 4B are graphs showing the relationship between the time lag in ink bubble generation by each part of the heat-generating-resistor 13 according to this embodiment and the angle of the trajectory of a discharged ink droplet. The values plotted on the graphs are the results of a computer simulation. In the graphs, the X direction (note that this is the longitudinal axis θx and not the horizontal axis of the graphs) is the alignment direction of the nozzles 18 (i.e., the direction in which the two parts of the heat-generating-resistor 13 are aligned in parallel), and the Y direction (note that this is the longitudinal axis θy and not the longitudinal axis of the graphs) is the direction perpendicular to the X direction (or the printing paper feeding direction). Both the X and Y directions indicate the amount of deflection from 0°, which represents no deflection.

Figure 4C:
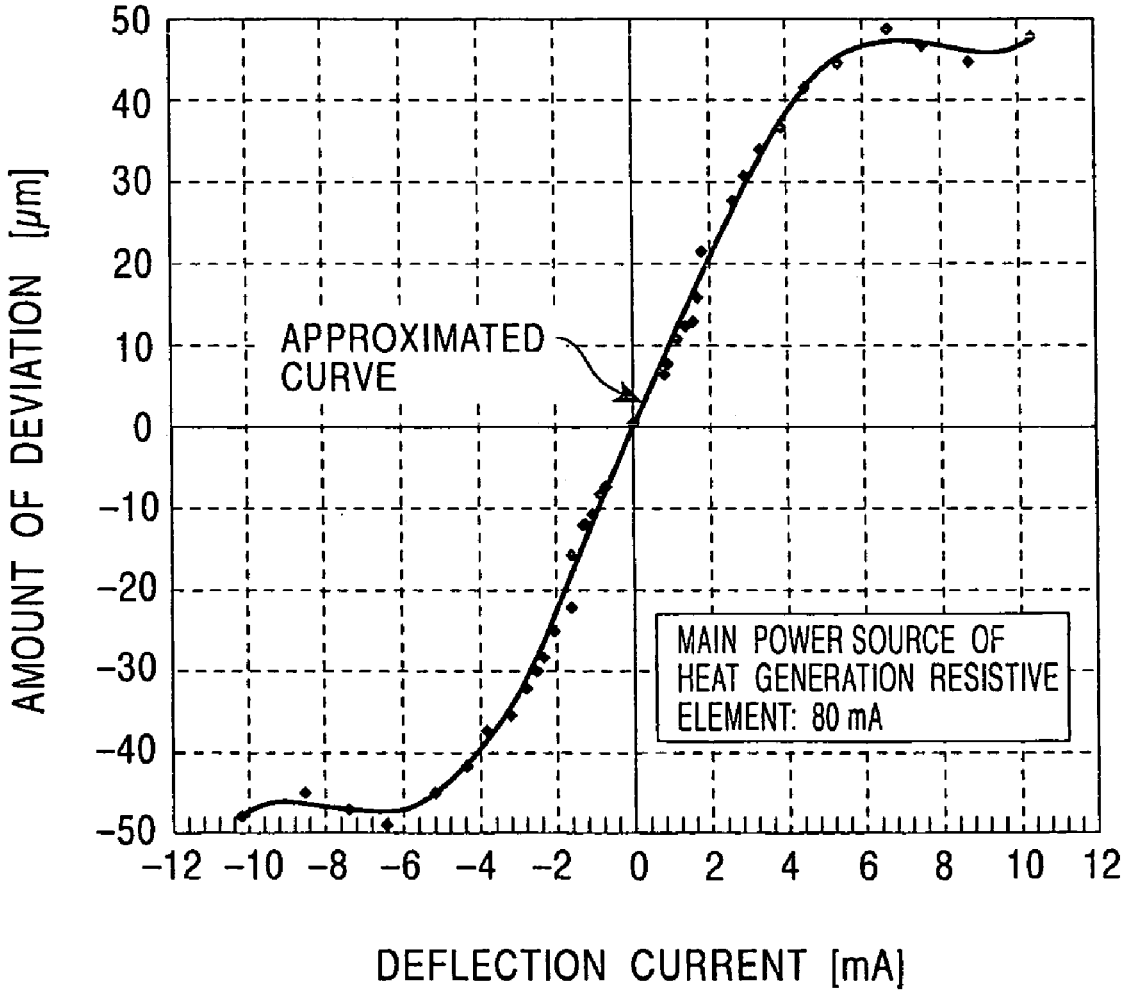

FIG. 4C shows the observed measurements for generating a time lag in the ink bubble generation of the two parts of the heat-generating-resistor 13. The horizontal axis represents a deflection current, which is one-half of the difference in the current between the two parts of one of the heat-generating-resistors 13. The vertical axis represents the amplitude of the deflection in the ink droplet-landing position indicated by the discharge angle of the ink droplet (X-direction) (where the distance between the nozzle 18 and the landing position is about 2 mm). In FIG. 4C, the main current of one of the heat-generating-resistors 13 is 80 mA. The deflection current is applied to one of the parts of the heat-generating-resistors 13 to deflect the trajectory of the ink droplet.

When there is a time lag in the bubble generation between the two parts of the heat-generating-resistor 13 aligned in the alignment direction of the nozzles 18, an ink droplet is not discharged in the direction perpendicular to the alignment direction of the nozzles 18. The ink droplet discharge angle θX in the alignment direction of the nozzles 18 becomes larger as the time lag in bubble generation becomes larger.

This embodiment takes advantage of this characteristic to enable the discharge of ink droplets in a plurality of directions by changing the amount of electricity supplied to each of the two parts of the heat-generating-resistor 13 so that a time lag in bubble generation occurs between the two parts.

Also, if the resistances of the two parts of a heat-generating-resistor 13 are not equal due to a manufacturing error, a time lag is generated between the two parts of the heat-generating-resistor 13. Thus, the trajectory of the ink droplet will not be along a direction perpendicular to the alignment direction of the nozzles 18, and the landing position of the ink droplet will be deflected from the expected position. By changing the amount of electricity supplied to each of the two parts of the heat-generating-resistor 13 so that a time lag in bubble generation occurs between the two parts of the heat-generating-resistor 13, the trajectory of the ink droplet will be perpendicular to the alignment direction of the nozzle 18.

Figure 5:
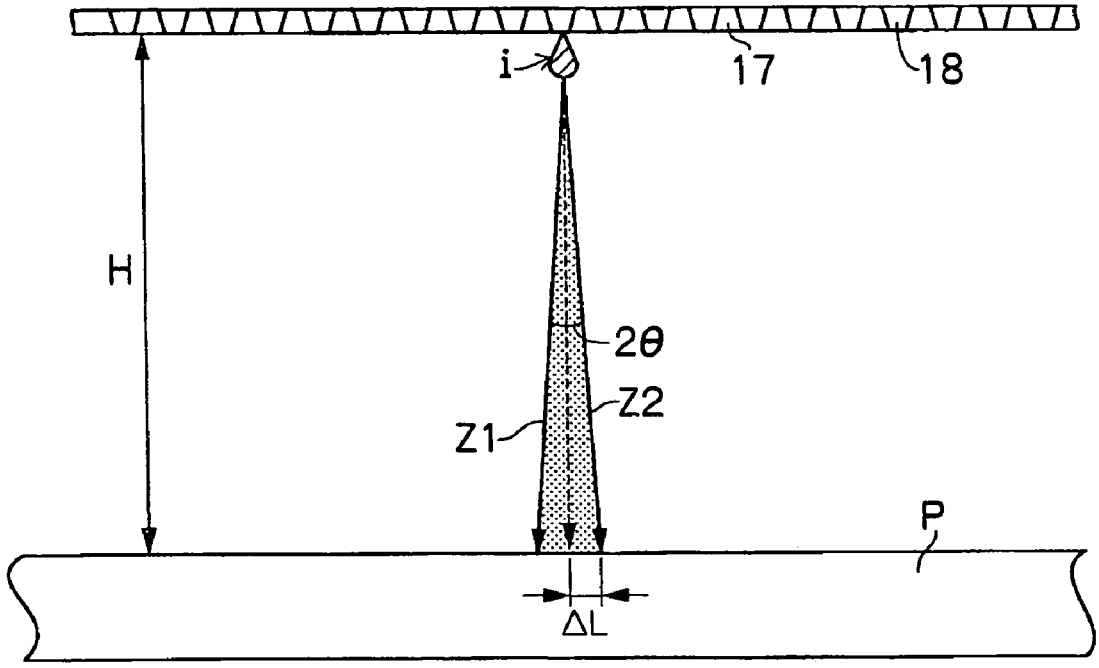
FIG. 5 illustrates the amplitude of the deflection in the trajectory of an ink droplet.

In the following, the trajectory of discharged ink droplets and the amplitude of the deflection in the trajectory of the ink droplets are described. FIG. 5 illustrates the amplitude of the deflection of the trajectory of a discharged ink droplet i. As illustrated in FIG. 5, when an ink droplet i is discharged perpendicularly to the discharging surface, the trajectory of the ink droplet i is not deflected, as shown by the dotted arrow in FIG. 5. On the other hand, when the trajectory of the ink droplet i is deflected by θ degrees from the direction perpendicular to the alignment direction of the nozzles 18 (Z1 or Z2 in FIG. 5), the landing position of the deflected ink droplet i is defined by the formula below:

$$\Delta L = H \times \tan\theta.$$

Accordingly, when the trajectory of the ink droplet i is deflected by θ degrees from the direction perpendicular to the alignment direction of nozzles 18, the landing position of the ink droplet is displaced by ΔL.

The distance H between the tip of the nozzle 18 and the printing paper P is about 1 to 2 mm for an ordinary inkjet printer. Hereinafter, it is assumed that the distance H is maintained substantially constant at 2 mm.

The reason the distance H has to be maintained substantially constant is because if the distance H changes, the landing position of the ink droplet i will be displaced. In other words, when the ink droplet i is discharged from the nozzle 18 perpendicularly onto the surface of the printing paper P, the landing position of the ink droplet i does not change even if the distance H changes a certain amount. On the other hand, when the discharge trajectory of the ink droplet i is deflected, as described above, the landing position of the ink droplet i is displaced as the distance H changes.

When the resolution of the head 11 is 60 dpi, the distance between the adjacent nozzles 18 is:

$$25.40 \times 1{,}000/600 \approx 42.3\ \mu m.$$

(Secondary-control Executing Unit)

A first embodiment of a head 11 according to the present invention includes a secondary-control executing unit in addition to the above-mentioned main controlling unit and secondary controlling unit.

The secondary-control executing unit determines whether or not a liquid discharger is going to operate the secondary controlling Unit.

Figure 6:
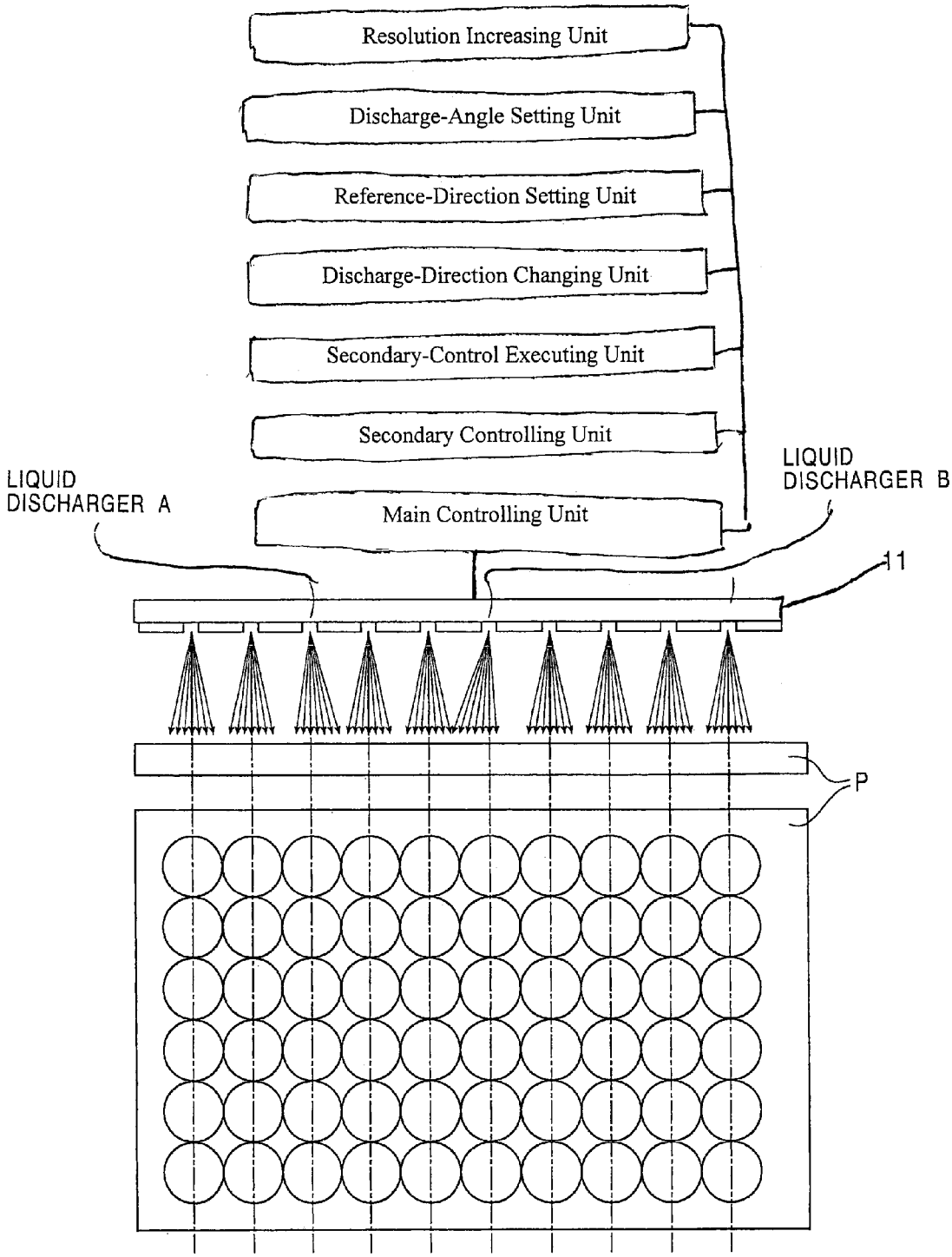
FIG. 6 illustrates the landing positions of ink droplets being compensated for by a main controlling unit, a secondary controlling unit, and a secondary-control executing unit.

FIG. 6 illustrates the landing position of ink droplets being compensated for by a main controlling unit, a secondary controlling unit, and a secondary-control executing unit. The upper portion of the drawing is a front view illustrating each liquid discharger of a head 11. The arrows indicate each trajectory of the ink droplets discharged from each liquid discharger using the main controlling unit and the secondary controlling unit. The bold arrows indicate the selected trajectories. The lower portion of the drawing is a plan view illustrating the ink droplets that have been discharged from each liquid discharger and landed on a recording medium. (The drawings in the following are also presented in the same way).

In FIG. 6, when only the main controlling unit is used, ink droplets are simply discharged from each liquid discharger. Alternatively, when the secondary controlling unit is used in addition to the main controlling unit, the ink droplets can be discharged along trajectories other than the trajectory determined by the main controlling unit. More specifically, three other trajectories are added to both the left and right of the trajectory determined by the main controlling unit. In other words, one trajectory is determined by the main controlling unit and six trajectories are determined by the secondary controlling unit. Thus each liquid discharger can discharge ink droplets along a total of seven trajectories.

In principle, when ink droplets are discharged directly below from each liquid discharger (substantially perpendicular to the printing paper P), the secondary controlling unit must not be used and only the main controlling unit must be used.

If, however, there is a liquid discharger that discharges ink droplets along a deflected trajectory compared to other liquid dischargers when ink droplets are discharged from all the liquid dischargers when using only the main controlling units, this liquid discharger must be adjusted using both the main controlling unit and the secondary controlling unit.

In order to do so, first, for example, a test pattern may be printed by discharging ink droplets from all the liquid dischargers using only the main controlling units. Then the printed result may be scanned using a scanner. By observing the scanned result, the liquid dischargers discharging ink droplets along a trajectory that is deflected more than a predetermined amount compared to other liquid dischargers can be detected. If a liquid discharger that discharges ink droplets along a deflected trajectory is detected, furthermore, the amount of deflection must be determined. Then the secondary controlling unit can be controlled so that the trajectory of the ink droplets is changed depending on the amount of deflection.

FIG. 6 illustrates an example wherein liquid dischargers A and B discharge ink droplets along deflected trajectories compared to the other liquid dischargers. In this case, the liquid dischargers excluding the liquid dischargers A and B use only the main controlling unit and only the trajectory in the middle of the seven possible trajectories is selected. On the contrary, the liquid dischargers A and B use both the main controlling unit and the secondary controlling unit to discharge ink droplets. For example, the liquid discharger A discharges ink droplets along the third trajectory from the left in the drawing, whereas the liquid discharger B discharges ink droplets along the sixth trajectory from left in the drawing.

As described above, for a liquid discharger that discharges ink droplets along a trajectory substantially the same as the designed trajectory, only the main controlling unit is used. On the contrary, for a liquid discharger that discharges ink droplets along a trajectory that is deflected from the designed trajectory, the secondary controlling unit is used to change the trajectory of the ink droplets discharged from the liquid discharger. In this way, the deflected trajectory is adjusted so as to become as parallel to the designed trajectory as possible.

Consequently, as shown in FIG. 6, the distance between the landing positions of the ink droplets discharged from each liquid discharger can be maintained substantially constant in a predetermined direction.

(Reference-direction Setting Unit)

A second embodiment of a head 11 according to the present invention includes a reference-direction setting unit in addition to the above-mentioned discharge-direction changing unit.

The reference-direction setting unit selects one trajectory as the reference trajectory among the plurality of trajectories set by the discharge-direction changing unit for each liquid discharger.

Similar to the above, as illustrated in FIG. 6, the discharge-direction changing unit sets seven different trajectories of ink droplets for each liquid discharger.

At first, the reference-direction setting unit sets the trajectory in the middle of the seven trajectories as the reference trajectory.

Similar to the above, first, a test pattern is printed to detect whether or not there are any liquid dischargers having a discharge trajectory that is deflected more than the predetermined amplitude. Then, if a deflected liquid discharger is detected, the reference trajectory can be changed according to the deflection of the trajectory.

For example, the liquid dischargers A and B in FIG. 6 have discharge trajectories that are deflected more than the predetermined amplitude. In this case, for the liquid discharger A, if the third trajectory from the left in the drawing is set to be the reference trajectory, the deflection of the discharge trajectory can be compensated for. Similarly, for the liquid discharger B, if the sixth trajectory from the left in the drawing is set to be the reference trajectory, the deflection of the discharge trajectory can be compensated for.

In FIG. 6, the trajectory closest to the direction perpendicular to the surface of the printing paper P is selected as the reference trajectory. The reference trajectory, however, is not limited to this.

For example, if a large number of the liquid dischargers have their discharge trajectories deflected to the right in the drawing, the trajectory in the middle of the seven trajectories may be set to be the reference trajectory for the liquid discharger A. Then, for the other liquid dischargers, or, for example, the liquid discharger on the left of the liquid discharger A, the seventh trajectory from the left (or the rightmost trajectory) can be set to be the reference trajectory.

In this way, the reference trajectory for each liquid discharger will not be the trajectory closest to the direction perpendicular to the surface of the printing paper P although this will not cause any problems.

(Discharge-angle Setting Unit)

A third embodiment of a head 11 according to the present invention includes a discharge-angle setting unit in addition to the above-mentioned discharge-direction changing unit.

The discharge-angle setting unit sets the angle of the trajectory of discharged ink droplets selected by the discharge-direction changing unit for each liquid discharger.

Figure 7:
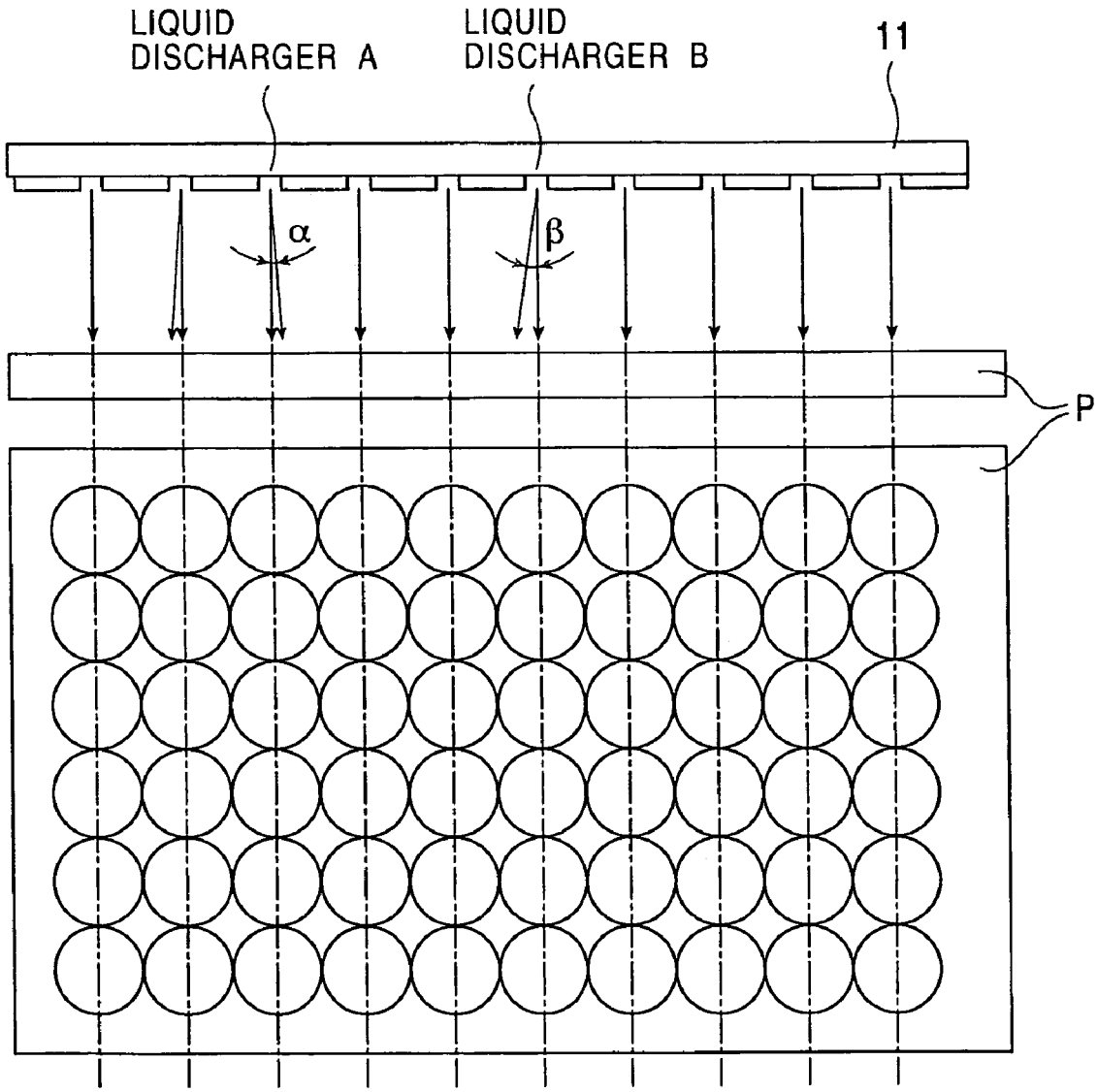
FIG. 7 illustrates the landing positions of ink droplets being compensated for by a discharge-direction changing unit and a discharge-angle setting unit.

FIG. 7 illustrates an embodiment wherein the landing positions of ink droplets are compensated for by the discharge-direction changing unit and the discharge-angle setting unit.

Each liquid discharger is capable of discharging ink droplets along seven trajectories as described in the embodiment above. Moreover, each liquid discharger discharges ink droplets along the trajectory in the middle of the seven trajectories (the fourth trajectory from the left).

In this embodiment, as shown in FIG. 7, the liquid dischargers excepting liquid dischargers A and B discharge ink droplets along a trajectory substantially perpendicular to the surface of printing paper P. The liquid discharger A has a trajectory deflected to the right by $\alpha$ degrees, and the liquid discharger B has a trajectory deflected to the left by $\beta$ degrees.

In such a case, the discharge-angle setting unit of the liquid discharger A shifts the entire discharge range to the left by $\alpha$ degrees. Moreover, the discharge-angle setting unit of the liquid discharger B shifts the entire discharge range to the right by $\beta$ degrees. In this way, the displacement of the ink droplet landing position will be less apparent.

Figure 8A:
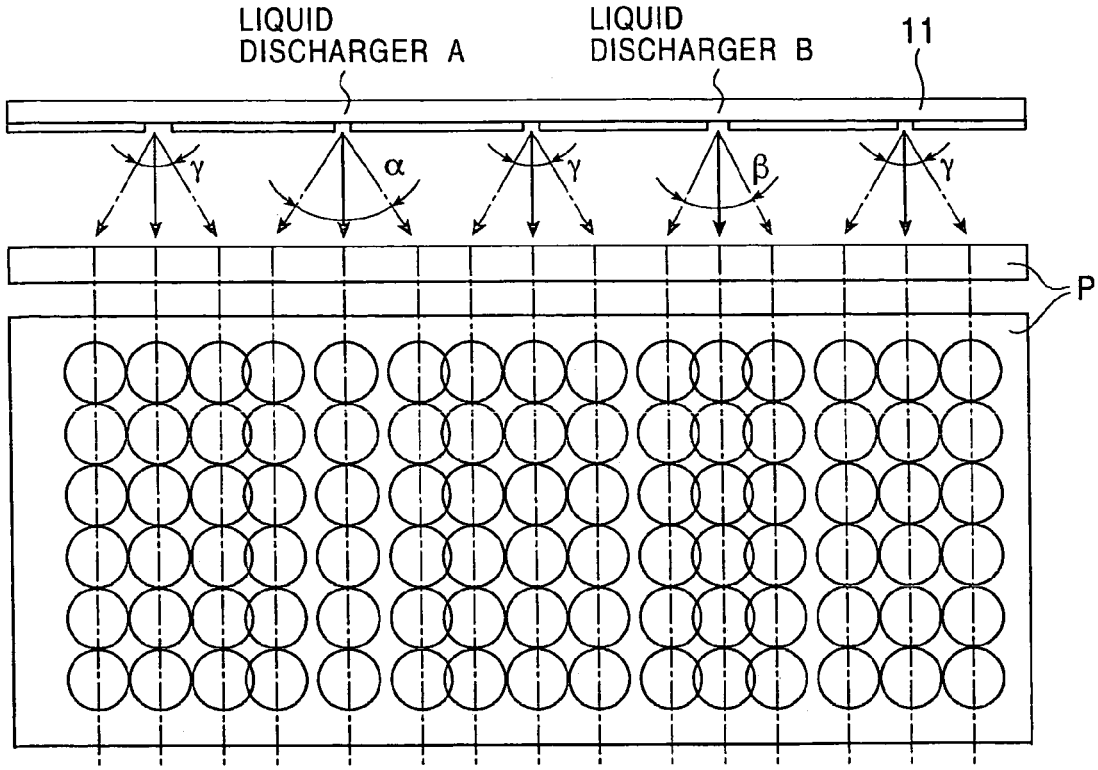
FIGS. 8A and 8B illustrate embodiments of a discharge direction setter.
Figure 8B:
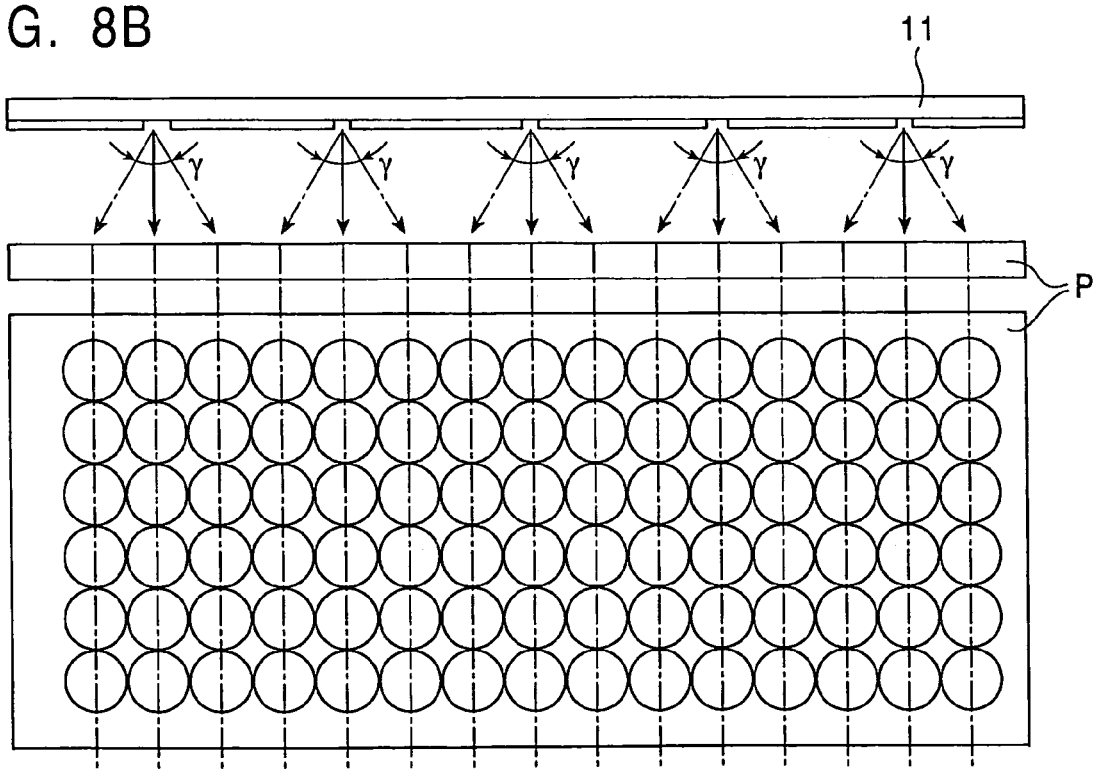

FIGS. 8A and 8B illustrate another embodiment of the discharge-angle setting unit. As shown in FIG. 8A, each liquid discharger can discharge ink droplets along a plurality of trajectories. Also, all of the liquid dischargers are capable of discharging ink droplets perpendicularly to the surface of printing paper P when the middle trajectory is selected.

The intended angle between the leftmost trajectory and the rightmost trajectory in the drawing is $\gamma$ degrees. The designed angle for the liquid discharger A is $\alpha$ ($>\gamma$) degrees and the intended angle for the liquid discharger B is $\beta$ ($<\gamma$) degrees.

Since the liquid dischargers A and B have different maximum discharge angles compared to the other liquid dischargers, the maximum discharge angle of the liquid discharger A is reduced so that angle $\alpha$ becomes angle $\gamma$. Similarly, the maximum discharge angle of the liquid discharger B is increased so that angle $\beta$ becomes angle $\gamma$.

In this way, as shown in FIG. 8B, the maximum discharge angle for all the liquid dischargers including the liquid dischargers A and B is set to angle $\gamma$.

By adjusting the maximum discharge angle, as described above, the trajectories of the ink droplets can be compensated for over a wider range compared to a case where the maximum discharge angle is not adjusted.

A fourth embodiment of a head 11 according to the present invention includes a discharge-angle setting unit and a reference-direction setting unit in addition to the above-mentioned discharge-direction changing unit.

In other words, the discharge-angle setting unit sets the ink droplet discharge angle for each liquid discharger, and the reference-direction setting unit selects one ink droplet trajectory among a plurality of trajectories as the reference trajectory.

Figure 9:
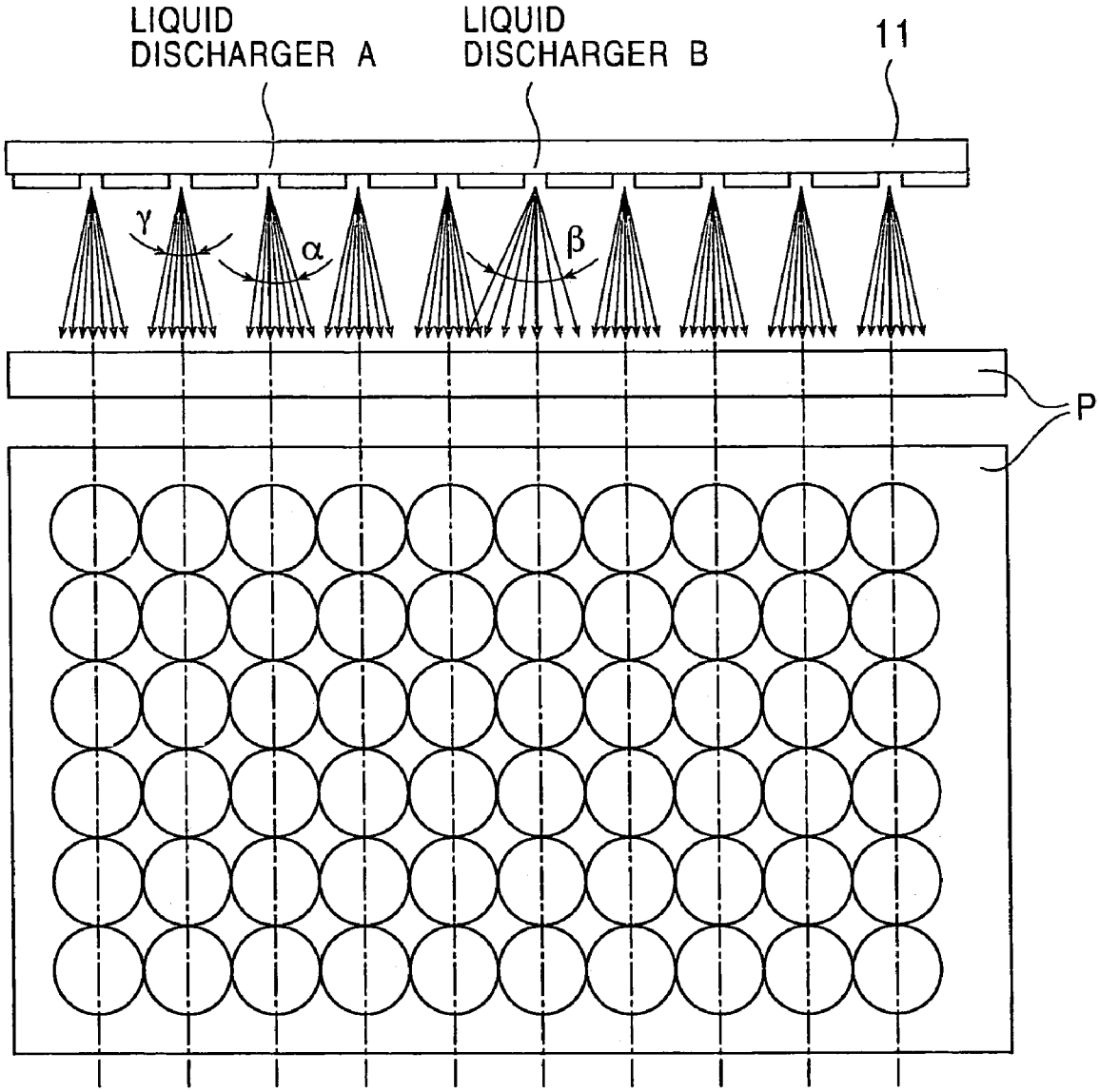
FIG. 9 illustrates the landing positions of ink droplets compensated for by a discharge-direction changing unit, a discharge-angle setting unit, and a reference-direction setting unit.

FIG. 9 illustrates an embodiment wherein the landing positions of ink droplets are compensated for by the discharge-direction changing unit, the discharge-angle setting unit, and the reference-direction setting unit.

Each of the liquid dischargers in FIG. 9 is capable of discharging ink droplets along seven trajectories using the discharge-direction changing unit. The angle formed between the leftmost trajectory and the rightmost trajectory among the seven trajectories in the drawing is $\gamma$ degrees.

In FIG. 9, the liquid dischargers excepting the liquid dischargers A and B do not have any deflected trajectories. Therefore, the discharge-angle setting units of the liquid dischargers excepting the liquid dischargers A and B maintain the maximum discharge angle of $\gamma$ degrees and the reference-direction setting units select the middle trajectory of the seven trajectories (the fourth trajectory from the left in the drawing) of each liquid discharger as the reference trajectory.

On the other hand, the discharge-angle setting unit of the liquid discharger A sets the maximum discharge angle to $\alpha$ ($<\gamma$) degrees and the reference-direction setting unit selects the third trajectory from the left in the drawing as the reference trajectory. In this way, the pitches of the landing positions of the ink droplets discharged from the liquid dischargers A and B can be matched with the pitches of the landing positions of the ink droplets discharged from the other liquid dischargers.

The discharge-angle setting unit of the liquid discharger B sets the maximum discharge angle to $\beta$ ($>\gamma$) degrees and the reference-direction setting unit selects the fifth trajectory from the left in the drawing as the reference trajectory. In this way, similar to the liquid discharger A, the pitches of the landing positions of the ink droplets discharged from the liquid dischargers A and B can be matched with the pitches of the landing positions of the ink droplets discharged from the other liquid dischargers.

As described above, the displacement of the landing positions of the ink droplets discharged from the liquid dischargers A and B can be compensated for by changing the discharge angle of the liquid dischargers A and B in accordance with the other liquid dischargers.

(First Discharge Controlling Unit)

In this embodiment, a head 11 having a discharge-direction changing unit or a main controlling unit and secondary controlling unit, a reference-direction setting unit, and a discharge-angle setting unit is used to control the ink droplet discharge by employing a first discharge controlling unit, as described in the following.

The first discharge controlling unit controls the discharge of ink droplets so that at least two of the liquid dischargers neighboring each other use discharge-direction changing units to discharge ink droplets along different trajectories to form a pixel row or a pixel by controlling these ink droplets to land in the same pixel row or pixel area, respectively.

A first embodiment of the first discharge controlling unit according to the present invention changes the discharge trajectory of the ink droplets discharged from each nozzle 18 in $2^J$ directions (an even number of directions) by a J bit control signal (where J is a positive integer). The distance between the two ink droplets that are discharged along one of the $2^J$ trajectories and that land furthest from each other is about $(2^J-1)$ times the distance between two adjacent nozzles 18. Each nozzle 18 discharges ink droplets along one of the $2^J$ trajectories.

A second embodiment of the first discharge controlling unit according to the present invention changes the discharge trajectory of the ink droplets discharged from each nozzle 18 in $(2^J+1)$ directions (an odd number of directions) by a J+1 bit control signal (where J is a positive integer). The distance between the two ink droplets that are each discharged along one of the $(2^J+1)$ trajectories and that land furthest from each other is about $2^J$ times the distance between two adjacent nozzles 18. Each nozzle 18 discharges ink droplets along one of the $(2^J+1)$ trajectories.

For example, in the above-mentioned first embodiment, if J=2, and a J bit control signal is used, the number of ink droplet trajectories is $2^J=4$ (which is an even number). The distance between the two ink droplets that land furthest from each other is about $(2^J-1)=3$ times the distance between two adjacent nozzles 18.

According to this embodiment, if the resolution of the head 11 is 600 dpi, the distance between two adjacent nozzles 18 is 42.3 μm. Thus, the distance between the two ink dots that have landed furthest from each other when the ink discharge trajectories are deflected by the first discharge controlling unit is three times 42.3 μm, i.e., 126.9 μm. Accordingly, the deflection angle $\theta$ is:

$$\tan 2\theta = 126.9/2{,}000 \approx 0.0635, \text{ hence}$$

$$\theta \approx 1.8 \text{ (deg)}.$$

In the above-mentioned second embodiment, if J=2, and a J+1 bit control signal is used, the number of ink droplet trajectories is $2^J+1=5$ (which is an odd number). The distance between the two ink droplets that land furthest from each other is about $2^J=4$ times the distance between two adjacent nozzles 18.

Figure 10:
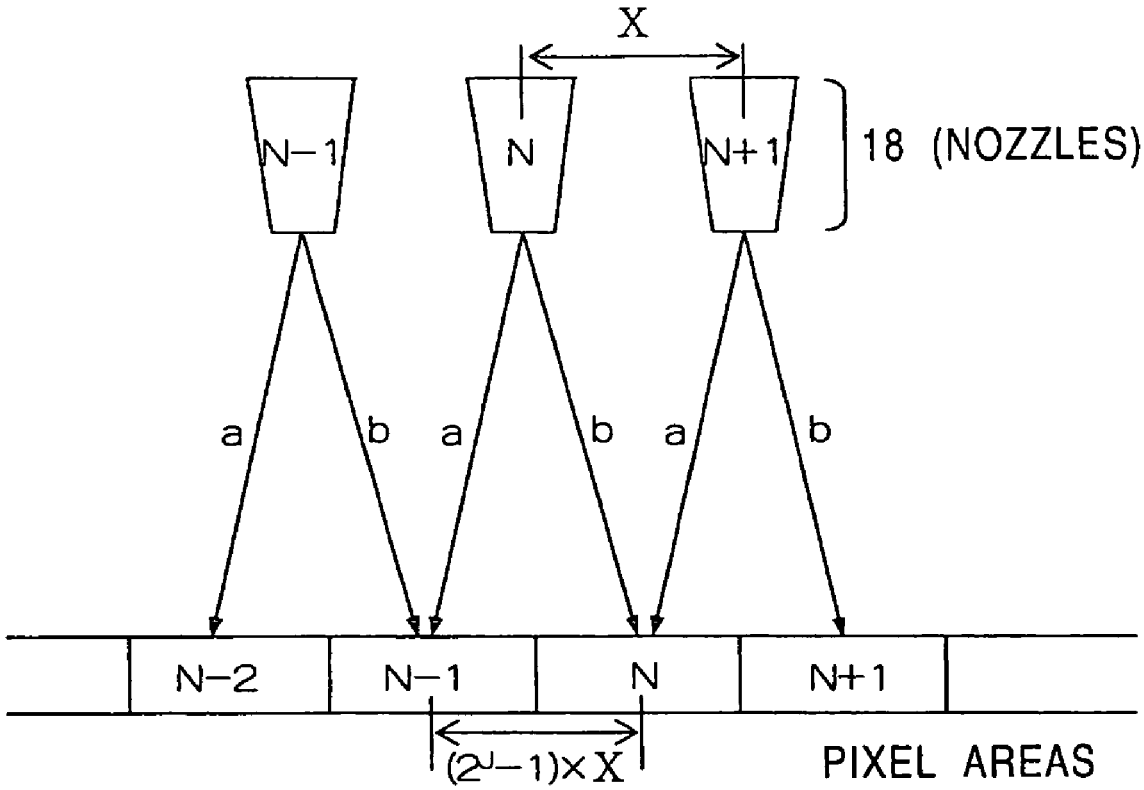
FIG. 10 illustrates neighboring liquid dischargers discharging ink droplets onto the same pixel, wherein the liquid dischargers are capable of discharging ink droplets in an even number of directions.

FIG. 10 illustrates a specific case of the ink discharge trajectories according to the above-mentioned when a 1 bit control signal (J=1) is used. In this embodiment, the discharge trajectories of each liquid discharger can be set so that the trajectories are symmetrical.

The distance between the landing positions of the two ink droplets furthest from each other is one times, i.e., $(2^J-1)$ times, the distance between two adjacent nozzles 18. As shown in FIG. 10, ink droplets can be discharged onto the same pixel area from the nozzles 18 of two adjacent liquid dischargers. More specifically, as shown in FIG. 10, if the distance between two adjacent nozzles 18 is X, then the distance between two adjacent pixel areas is $(2^J-1)\times X$ (for the example illustrated in FIG. 10, $(2^J-1)\times X=X$ since J=1).

In this case, the landing position of the ink droplets is between the nozzles 18.

Figure 11:
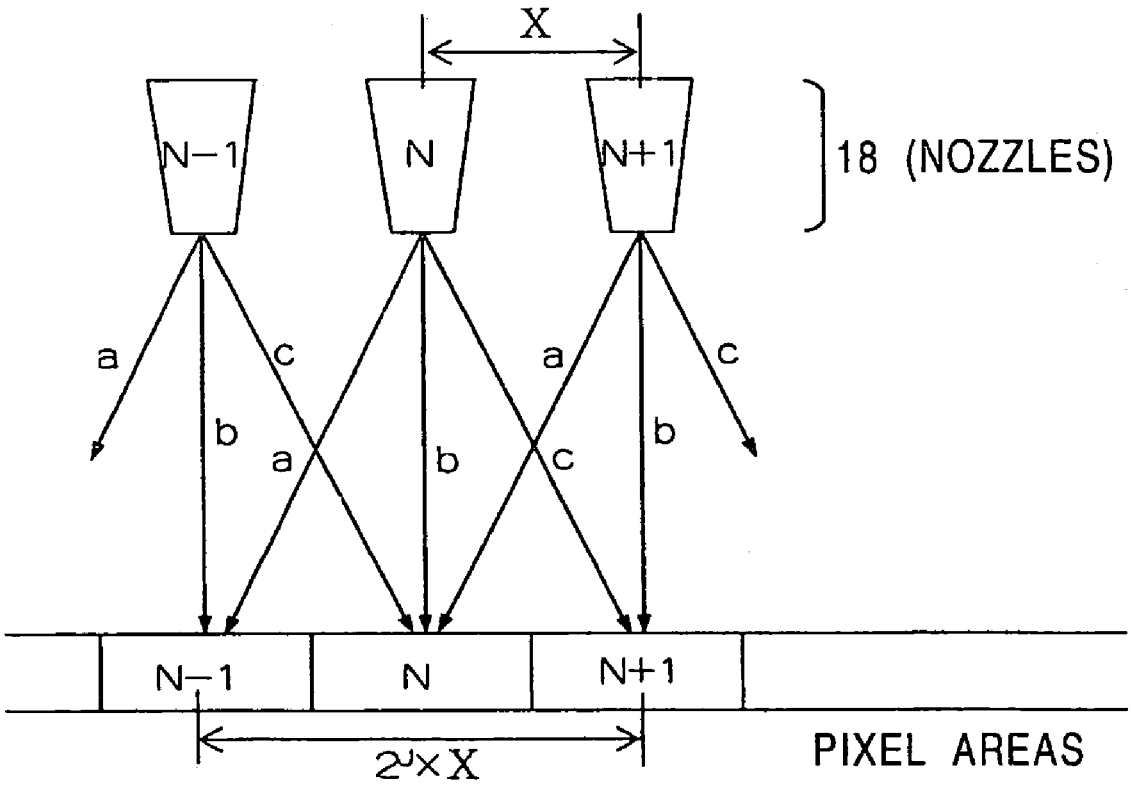
FIG. 11 illustrates liquid dischargers discharging ink droplets to the left and right in symmetrical trajectories and to directly below, wherein the liquid dischargers are capable of discharging ink droplets in an odd number of directions.

FIG. 11 illustrates a specific case of the ink discharge trajectories according to the above-mentioned when a 2 bit control signal (J+1=2) is used. In this embodiment, the discharge trajectories of each liquid discharger can be set so that there are an odd number of trajectories. In other words, in the first embodiment, the discharge trajectories of each liquid discharger can be set so that there are an even number of symmetrical trajectories, whereas for the second embodiment, by adding 1 to the number of bits of the control signal of the first embodiment, ink droplets can be discharged from the nozzles 18 in a direction perpendicular to the surface of the printing paper. More specifically, the liquid discharger according to the second embodiment can discharge ink droplets in an odd number of directions, which includes the symmetrical trajectories (trajectories a and c in FIG. 11) and the perpendicular trajectory (trajectory b in FIG. 11).

In the example illustrated in FIG. 11, J=1 and thus the control signal is J+1=2 bits. The number of available trajectories is $(2^J+1)=3$, which is an odd number. The distance(X in FIG. 11) between the two ink droplets that are each discharged along one of the $(2^J+1)$ trajectories and that land furthest from each other is about $2^J=2$ times the distance between two adjacent nozzles 18 ($2^J \times X$ in FIG. 11). When an ink droplet is discharged, one of the $(2^J+1)=3$ trajectories is selected.

In this way, as shown in FIG. 11, ink droplets can be discharged onto pixel areas N−1 and N+1 in addition to the pixel area right below nozzle N.

The landing positions of the ink droplets are positions opposite the nozzles 18.

As described in the above, depending on the control signal, at least two neighboring liquid dischargers (nozzles 18) are capable of discharging ink droplets onto a same pixel area. In particular, when the alignment pitch in the alignment direction of the liquid dischargers is X, as shown in FIGS. 10 and 11, the landing position of the droplets discharged from each liquid discharger can be determined by the formula below:

$$\pm(\tfrac{1}{2}\times X)\times P \text{ (where P is a positive integer).}$$

In this case, the landing position is a position relative to the center of the liquid discharger and in alignment with the alignment direction of the liquid dischargers.

Figure 12:
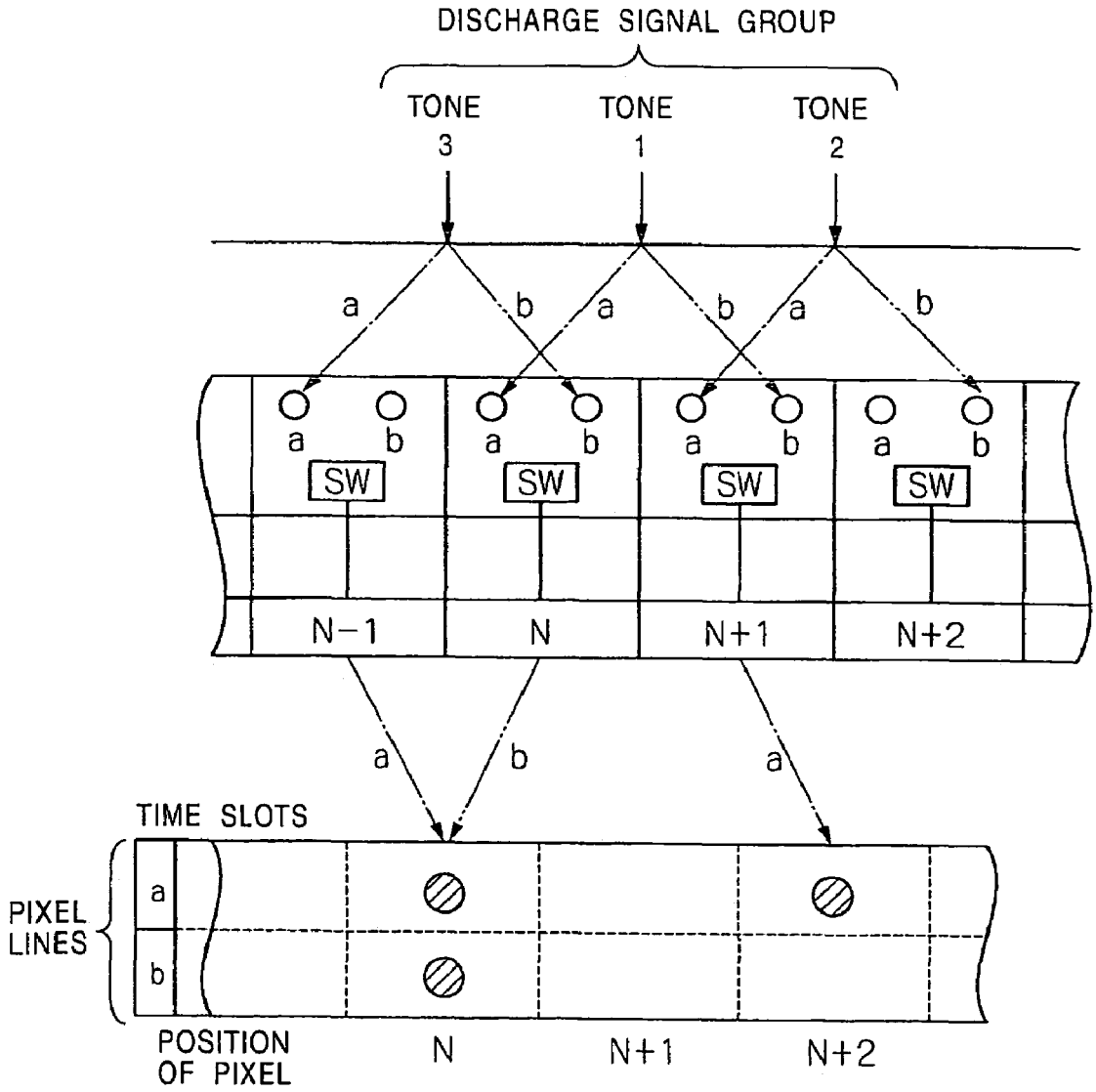
FIG. 12 illustrates the process of forming pixels on printing paper by liquid dischargers based on discharging signals when the liquid dischargers discharge droplets in two directions (when the droplets can be discharged in an even number of directions)

FIG. 12 illustrates a first embodiment of a first discharge controlling unit (which is capable of discharging ink droplets along an even number of trajectories). The drawing illustrates a method for forming pixels (with two trajectories for discharging ink droplets) when a J=1 bit-control signal is used.

FIG. 12 illustrates the process for forming pixels on printing paper with liquid dischargers by processing discharge signals sent to a head 11 in parallel. The discharge signal corresponds to an image signal.

In FIG. 12, the discharge signal for pixel N is tone 3, pixel N+1 is tone 1, and pixel N+2 is tone 2.

The discharge signal for each pixel is sent to a predetermined liquid discharger in a cycle a or b. Then ink droplets are discharged from each liquid discharger in the cycle a or b. The cycles a and b correspond to the time slots a and b. A plurality of dots corresponding to the tone commanded by the discharge signal is formed inside one pixel area during every cycle a or b. For example, in the cycle a, the discharge signal for the pixel N is sent to the liquid discharger N−1 and the discharge signal for the pixel N+2 is sent to the liquid discharger N+1.

An ink droplet is discharged from the liquid discharger N−1 along a deflected trajectory a and lands in the position corresponding to pixel N on the printing paper. An ink droplet is also discharged from the liquid discharger N+1 along the deflected trajectory a and lands in the position corresponding to pixel N+2 on the printing paper.

In this way, ink droplets corresponding to tone 2 land in an area corresponding to each pixel on the printing paper for the time slots a. Since the tone for the pixel N+2 commanded by the discharge signal is tone 2, the pixel N+2 is formed in tone 2. A similar process is repeated for the time slots b.

As a result, pixel N is formed by two dots, which is the number of dots corresponding to tone 3.

By the above-mentioned processes, a pixel of any tone is never formed by the same liquid discharger discharging ink droplets twice in a row in the pixel area corresponding to the pixel. Therefore, in this way, the effect of the variation in each liquid discharger can be reduced. Furthermore, for example, even if the amount of ink in an ink droplet discharged from a liquid discharger is insufficient, the variation in the size of each pixel formed of dots can be reduced.

In a case in which pixels formed of one or more dots on the Mth dot line and the M+1th dot line are linearly aligned, it is preferable to control two different liquid dischargers for discharging the first ink droplets of the Mth pixel line and the M+1th pixel line.

In this way, for example, when a pixel is formed of one dot (when the pixel is tone 2), pixels formed by the same liquid discharger are not aligned on the same line. Moreover, when a pixel is formed of a small number of pixels, the pixels formed by using the same liquid discharger for discharging the first dot are not aligned on the same line.

For instance, there might be a case in which pixels formed of one ink droplet are aligned on the same line and the liquid discharger used to discharge the ink droplets fails to discharge ink droplets because of clogging. If, in such a case, only one liquid discharger is used for discharging the ink droplets, the pixel row will include no pixels once the liquid discharger fails. By employing the above-mentioned discharge method, however, this kind of failure can be avoided.

Other than the above-mentioned discharger method, a method wherein the liquid dischargers are selected randomly may be used. The liquid dischargers for discharging the first ink droplets of the Mth pixel line and the M+1th pixel should always be different liquid dischargers.

Figure 13:
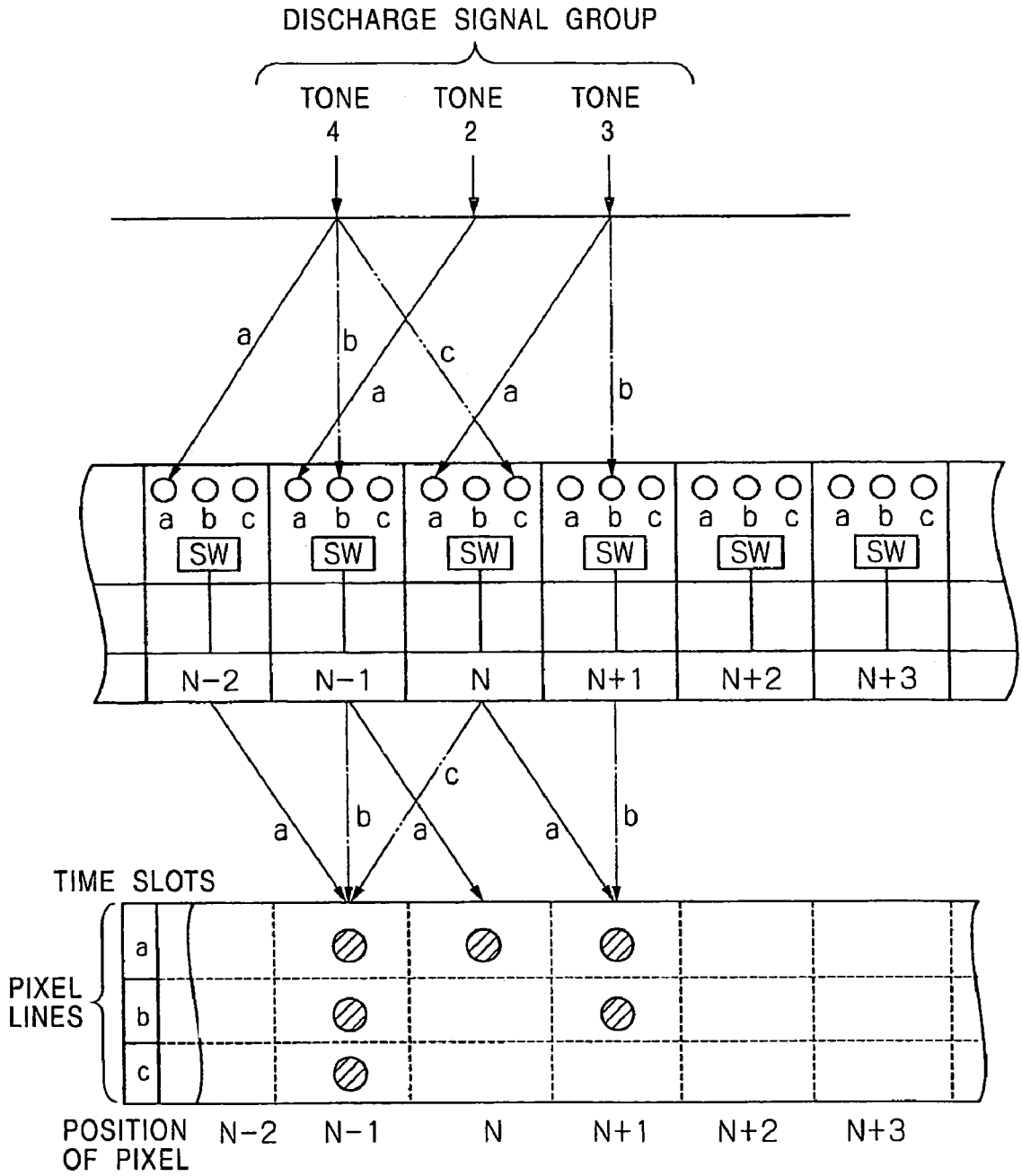
FIG. 13 illustrates the process of forming pixels on printing paper by liquid dischargers based on discharging signals when the liquid dischargers discharge droplets in three directions (when the droplets can be discharged in an odd number of directions)

FIG. 13 illustrates a second embodiment of a first discharge controlling unit (which is capable of discharging ink droplets along an odd number of trajectories). The drawing illustrates a method for forming pixels (with three trajectories for discharging ink droplets) when J=1 and a J+1=2 bit control signal is use.

The pixel forming process illustrated in FIG. 13 is the same as that of FIG. 12, and, therefore, descriptions are omitted. As well as the first embodiment, the second embodiment employs the first discharge controlling unit to control the discharge of ink droplets of at least two neighboring liquid dischargers so that a pixel row or a pixel is formed.

(Second Discharge Controlling Unit)

In this embodiment, a head 11 having an above-mentioned discharge-direction changing unit, or a main controlling unit and a secondary controlling unit, a reference-direction setting unit, and the discharge-angle setting unit is used to control the discharge of ink droplets by employing a second discharge controlling unit, as described in the following.

The second discharge controlling unit selects a landing position (or more accurately a target position) in a predetermined direction in a pixel area for each ink droplet discharged from a liquid discharger. The landing position is selected among M (where M is an integer equal to or greater than 2) different landing position in which at least a part of the landing area is included in the pixel area. Then, the second discharge controlling unit controls the discharge of ink droplets so that they land in the selected landing position.

In particular, in this embodiment, the second discharge controlling unit randomly (i.e., irregularly or without order) selects a landing position among the different M landing positions. Many different methods for randomly selecting a landing position may be employed. For instance, a landing position may be selected among the M different landing positions by using a random number generating circuit.

In this embodiment, the M landing positions are overlappingly aligned at a pitch of about 1/M of the alignment pitch of the liquid dischargers (nozzles 18).

Figure 14:
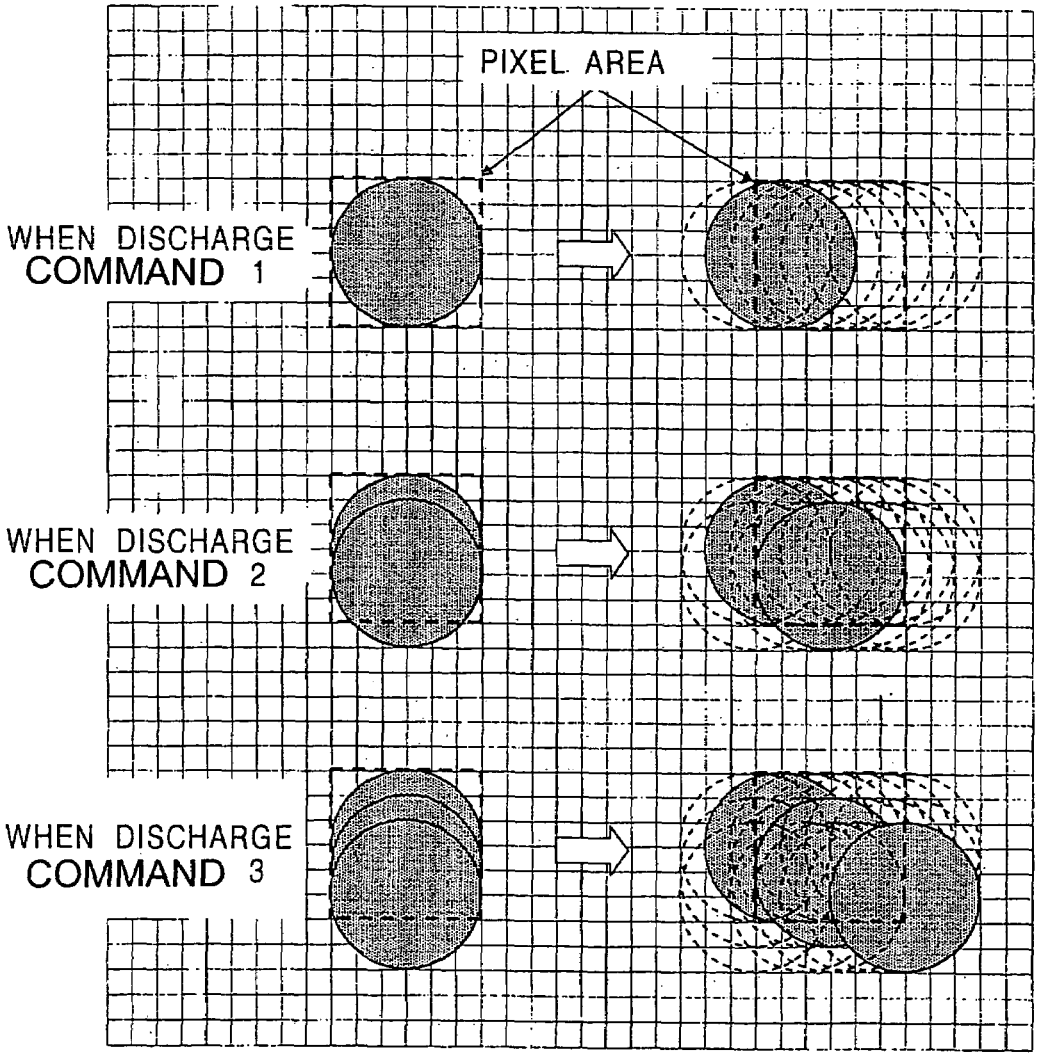
FIG. 14 is a plan view illustrating an ink droplet that has landed in one of the different landing positions in one pixel area.

FIG. 14 is a plan view of ink droplets that have landed in one or more of the M different landing positions for each pixel area. Known landing positions (left in the drawing) and landing positions according to this embodiment (right in the drawing) are compared. In FIG. 14, the area surrounded by a dotted square is the pixel area. The area surrounded by a circle is the ink droplet (or dot) that has landed in the pixel area.

In known printing, when the discharge command is 1 (i.e., tone 2), an ink droplet lands in the pixel area so that most of the ink droplet fits inside the pixel area (in the upper drawing in FIG. 14, the ink droplet is indicated by an inscribed circle in the square).

Contrarily, for this embodiment, an ink droplet is discharged so that it lands in one of the M landing positions in the alignment direction of the nozzles 18. The upper drawing in FIG. 14 illustrates an ink droplet that has landed in one of the M=8 landing positions of one pixel area (the number M includes a case in which no ink droplets land in a landing position and, thus, in the drawing, the seven actual landing positions are illustrated). (In the drawing, the circle drawn in a solid line indicates an ink droplet that has landed in a landing position and the circles drawn in dotted lines indicate the other possible landing positions). The upper drawing in FIG. 14 illustrates an example wherein the discharge command is 1. In this example, the ink droplet has landed in the selected landing position, which is the second landing position from the left in the drawing.

When the discharge command is 2, two ink droplets are overlappingly discharged onto the same pixel area. In the example in FIG. 14, the feeding direction of the printing paper is taken into consideration, and thus, the second ink droplet is displaced downwards by one scale in the drawing.

In known methods, when the discharge command is 2, the second ink droplet lands on the same line as the first ink droplet (i.e., the ink droplets are not displaced to the left or right).

Contrarily, in this embodiment, as described in the above, the first ink droplet lands in a position randomly selected and then the second ink droplet also lands in a position selected independently from the first ink droplet. The middle drawing in FIG. 14 illustrates a second ink droplet that has landed in the pixel area so that its horizontal width fits exactly into the pixel area.

A case in which the discharge command is 3 is also the same as the case in which the discharge command is 2. In a known method, the three ink droplets land in one pixel area without any displacement in the horizontal direction. On the other hand, for the method according to this embodiment, each of the three ink droplets lands in a position selected unrelatedly from the other positions.

By discharging ink droplets as described above, the generation of streaks caused by the variation in the characteristic of the liquid dischargers in an image printed by forming pixel rows with overlapping dots can be prevented and the effect of the variation can be minimized.

In other words, the landing positions of the ink droplets (dots) become random. As a result, the alignment of the dots is uneven in a microscopic view but is uniform and isotropic in a macroscopic view. Thus, the effect of the variation in the characteristic of the liquid dischargers is minimized.

In this way, the variation in the characteristic of each liquid discharger discharging ink droplets can be minimized. Without randomizing the landing positions of the ink droplets, the dots are disposed in a regular pattern to generate an image. In such a case, interruptions in the pattern are easily noticeable visually. In particular, the shading of color of dots and lines is expressed by the area ratio of the dots and the background (the part of the printing paper not covered with dots), and, for this reason, the more regularity there is in the remaining background, the more easily visible the interruptions in the pattern of the dots become.

Contrary to this, by disposing dots irregularly and randomly, a small interruption in the alignment of the dots is unnoticeable.

In the case of a color line head including a plurality of line heads 10 supplying different colored inks for each line head 10, there is the following additional effect.

For a color inkjet printer, more accurate landing positions for ink droplets are required when pixels are formed by overlapping a plurality of ink droplets (dots) because the generation of moiré patterns must be prevented. Moiré patterns do not occur if ink droplets are randomly disposed as described in this embodiment and merely simple color shifts occur. Therefore, deterioration of image quality caused by the generation of moiré patterns can be prevented.

Moiré patterns are not that significant a problem for serial printers that drive a head repeatedly in the main scanning direction. Moiré patterns, however, are a problem for line printers. By discharging ink droplets onto random landing positions, moiré patterns are less likely to occur, and, thus, line inkjet printers may be easily produced.

Moreover, by discharging ink droplets onto random landing positions, the area in which ink droplets land becomes wider even though the total amount of ink discharged onto the printing paper is the same. For this reason, the amount of time required for drying the ink droplets can be reduced. In particular, for line printers, the effect is significant since the printing speed is faster (i.e., the time required for printing is shorter).

(Resolution Increasing Unit)

In this embodiment, a head 11 having a discharge-direction changing unit, or a main controlling unit and a secondary controlling unit, a reference-direction setting unit, and a discharge-angle setting unit is used to increase the resolution by employing a resolution increasing unit, as described in the following.

The resolution increasing unit controls the above-mentioned discharge-direction changing unit so that each liquid discharger discharges an ink droplet onto more than 2 different areas in a predetermined direction. In this way, the number of pixels can be increased compared to when pixels are formed by liquid dischargers that only discharge ink droplets in one area.

For example, when the distance between adjacent nozzles 18 is 42.3 μm, the physical (structural) resolution of the head 11 is 600 dpi.

By using the above-mentioned resolution increasing unit, each nozzle 18 can discharge ink droplets onto two areas in a predetermined direction. As a result, printing with a resolution of 1,200 dpi becomes possible. Similarly, if each nozzle 18 discharges ink droplets onto three areas in a predetermined direction, printing with a resolution of 1,800 dpi becomes possible.

Figure 15:
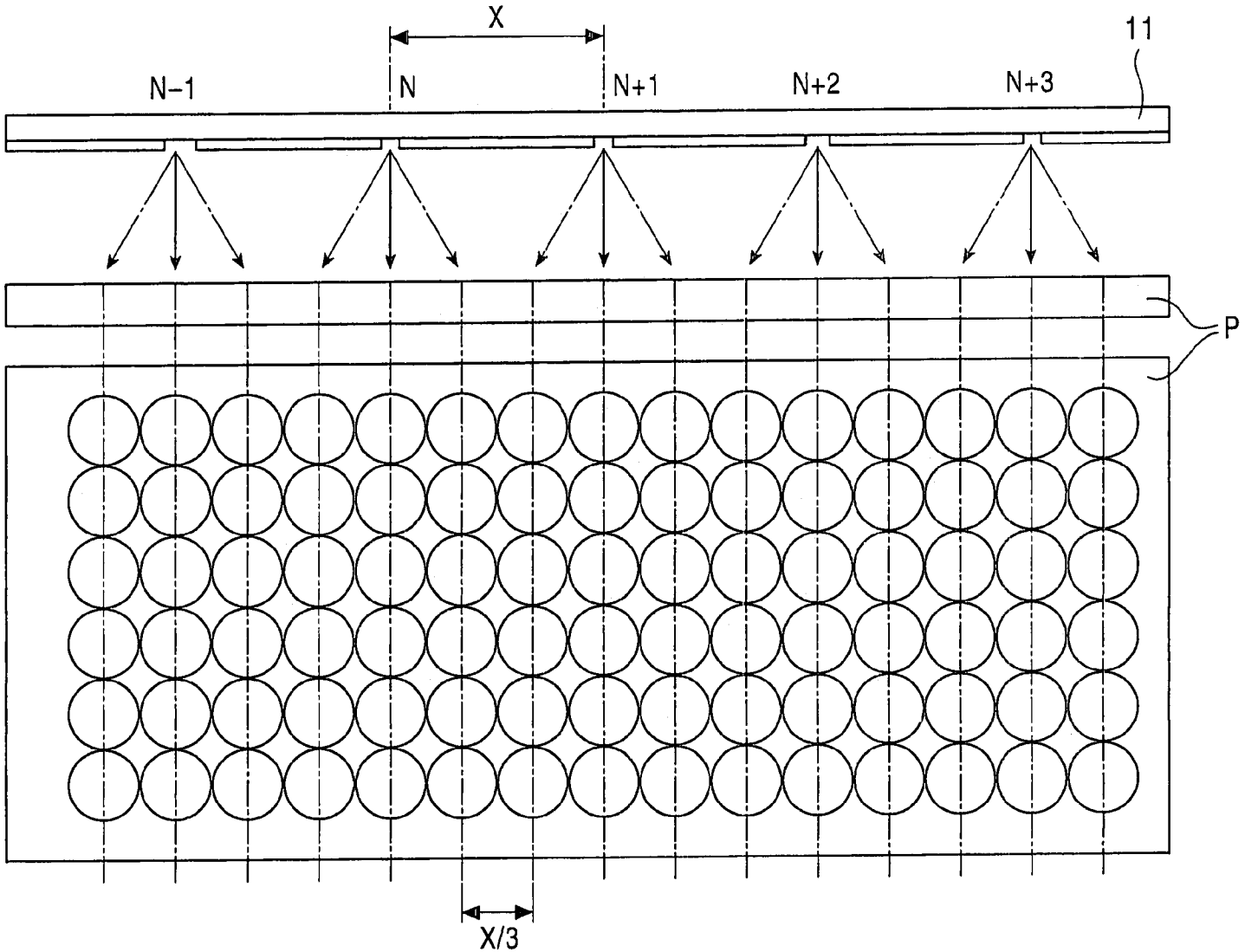
FIG. 15 illustrates the trajectories of ink droplets when using a resolution increasing unit.

FIG. 15 illustrates in detail the trajectories of ink droplets discharged from liquid dischargers using a resolution increasing unit. As shown in FIG. 15, for example, the distance between each liquid discharger is X, and each liquid discharger discharges ink droplets along a row (the alignment direction of nozzles 18) so that the ink droplets land in three areas with equal intervals. More specifically, for example, the distance between the landing position of an ink droplet discharged along the right trajectory in the drawing by the Nth liquid discharger and the landing position of an ink droplet discharged along the left trajectory in the drawing by the N+1th liquid discharger is controlled so that it equals X/3.

As described above, each liquid discharger discharges ink droplets in P different directions and the plurality of discharged ink droplets lands on printing paper with equal intervals in a predetermined direction. In this way, printing can be performed with a resolution that is P times the physical (structural) resolution of the head 11.

As described in the above, a first discharge controlling unit, a second discharge controlling unit, and a resolution increasing unit can be combined with a discharge-direction changing unit, a reference-direction setting unit, and a discharge-angle setting unit as listed below.

(1) A discharge-direction changing unit and a reference-direction setting unit combined with a first discharge controlling unit.

(2) A discharge-direction changing unit and a reference-direction setting unit combined with a second discharge controlling unit.

(3) A discharge-direction changing unit and a reference-direction setting unit combined with a first discharge controlling unit and a second discharge controlling unit.

(4) A discharge-direction changing unit and a reference-direction setting unit combined with a resolution increasing unit.

(5) A discharge-direction changing unit and a reference-direction setting unit combined with a first discharge controlling unit and a resolution increasing unit.

(6) A discharge-direction changing unit and a reference-direction setting unit combined with a second discharge controlling unit and a resolution increasing unit.

(7) A discharge-direction changing unit and a reference-direction setting unit combined with a first discharge controlling unit, a second discharge controlling unit, and a resolution increasing unit.

(8) A discharge-direction changing unit and a discharge-angle setting unit combined with a first discharge controlling unit.

(9) A discharge-direction changing unit and a discharge-angle setting unit combined with a second discharge controlling unit.

(10) A discharge-direction changing unit and a discharge-angle setting unit combined with a first discharge controlling unit and a second discharge controlling unit.

(11) A discharge-direction changing unit and a discharge-angle setting unit combined with a resolution increasing unit.

(12) A discharge-direction changing unit and a discharge-angle setting unit combined with a first discharge controlling unit and a resolution increasing unit.

(13) A discharge-direction changing unit and a discharge-angle setting unit combined with a second discharge controlling unit and a resolution increasing unit.

(14) A discharge-direction changing unit and a discharge-angle setting unit combined with a first discharge controlling unit and a second discharge controlling unit.

(15) A discharge-direction changing unit, a discharge-angle setting unit, and a reference-direction setting unit combined with a first discharge controlling unit.

(16) A discharge-direction changing unit, a discharge-angle setting unit, and a reference-direction setting unit combined with a second discharge controlling unit.

(17) A discharge-direction changing unit, a discharge-angle setting unit, and a reference-direction setting unit combined with a first discharge controlling unit and a second discharge controlling unit.

(18) A discharge-direction changing unit, a discharge-angle setting unit, and a reference-direction setting unit combined with a resolution increasing unit.

(19) A discharge-direction changing unit, a discharge-angle setting unit, and a reference-direction setting unit combined with a first discharge controlling unit and a resolution increasing unit.

(20) A discharge-direction changing unit, a discharge-angle setting unit, and a reference-direction setting unit combined with a second discharge controlling unit and a resolution increasing unit.

(21) A discharge-direction changing unit, a discharge-angle setting unit, and a reference-direction setting unit combined with a first discharge controlling unit, a second discharge controlling unit, and a resolution increasing unit.

Some of the above-mentioned combinations are described in detail in the following.

Figure 16:
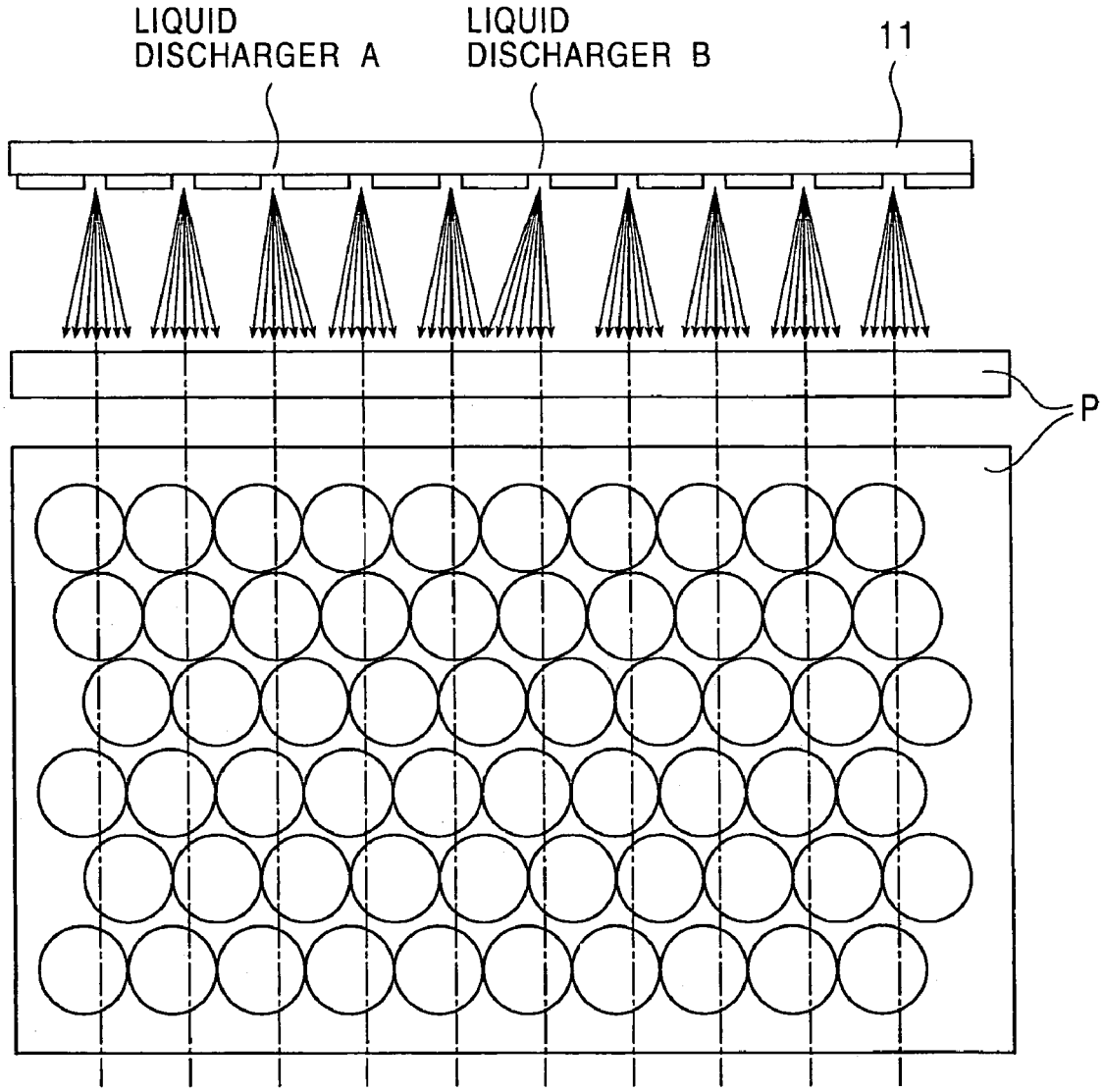
FIG. 16 illustrates liquid dischargers having a discharge-direction changing unit and a reference-direction setting unit combined with a second discharge controlling unit.

FIG. 16 illustrates the combination of (2) in the above wherein a discharge-direction changing unit and a reference-direction setting unit are combined with a second discharge controlling unit.

In FIG. 16, similar to FIG. 6, each liquid discharger is capable of discharging ink droplets along seven different trajectories by using a discharge-direction changing unit. Moreover, one of the trajectories is set to be a reference trajectory for each liquid discharger. By using a second discharge controlling unit, the landing positions of the ink droplets are randomly allotted onto the same pixel row for each pixel line.

Figure 17:
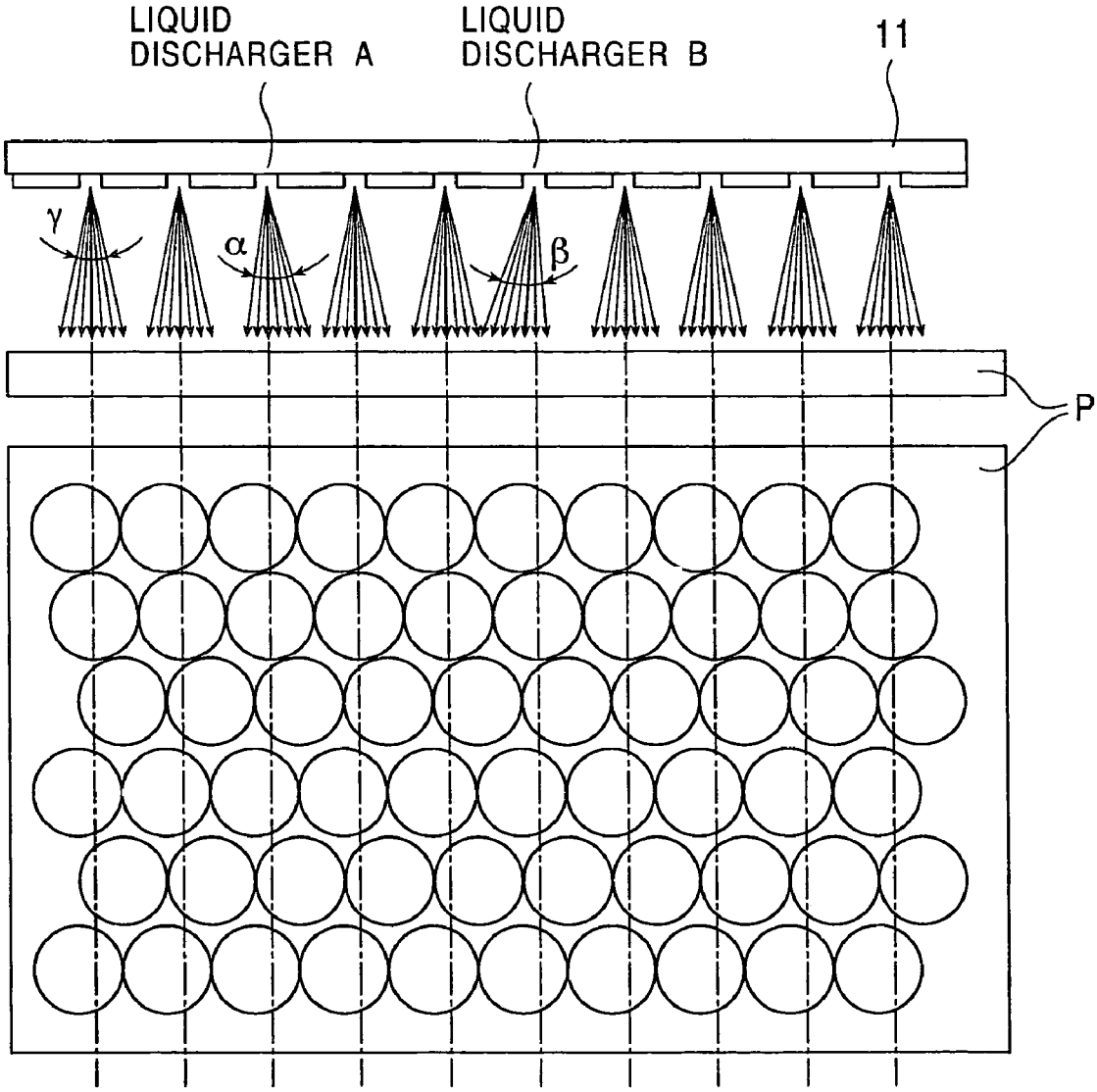
FIG. 17 illustrates liquid dischargers having a discharge-direction changing unit, a discharge-angle setting unit, and a reference-direction setting unit combined with a second discharge controlling unit.

FIG. 17 illustrates the combination of (16) in the above wherein a discharge-direction changing unit, a discharge-angle setting unit, and a reference-direction setting unit are combined with a second discharge controlling unit.

In FIG. 17, similar to FIG. 9, each liquid discharger is capable of discharging ink droplets along seven different trajectories by using a discharge-direction changing unit. Moreover, the angle formed between the leftmost trajectory and the rightmost trajectory among the seven trajectories (i.e., the maximum defection angle) is set to $\gamma$ degrees.

The discharge-angle setting unit sets the maximum deflection angles of liquid dischargers A and B to $\alpha$ and $\beta$ degrees, respectively. Moreover, the reference-direction setting unit sets reference trajectories for the liquid dischargers A and B as the third trajectory from the left and the fifth trajectory from the left, respectively. The reference trajectory for liquid dischargers excluding the liquid dischargers A and B is the fourth trajectory from the left.

By using a second discharge controlling unit, the landing positions of the ink droplets are randomly allotted onto each pixel row for each pixel line.

Figure 18:
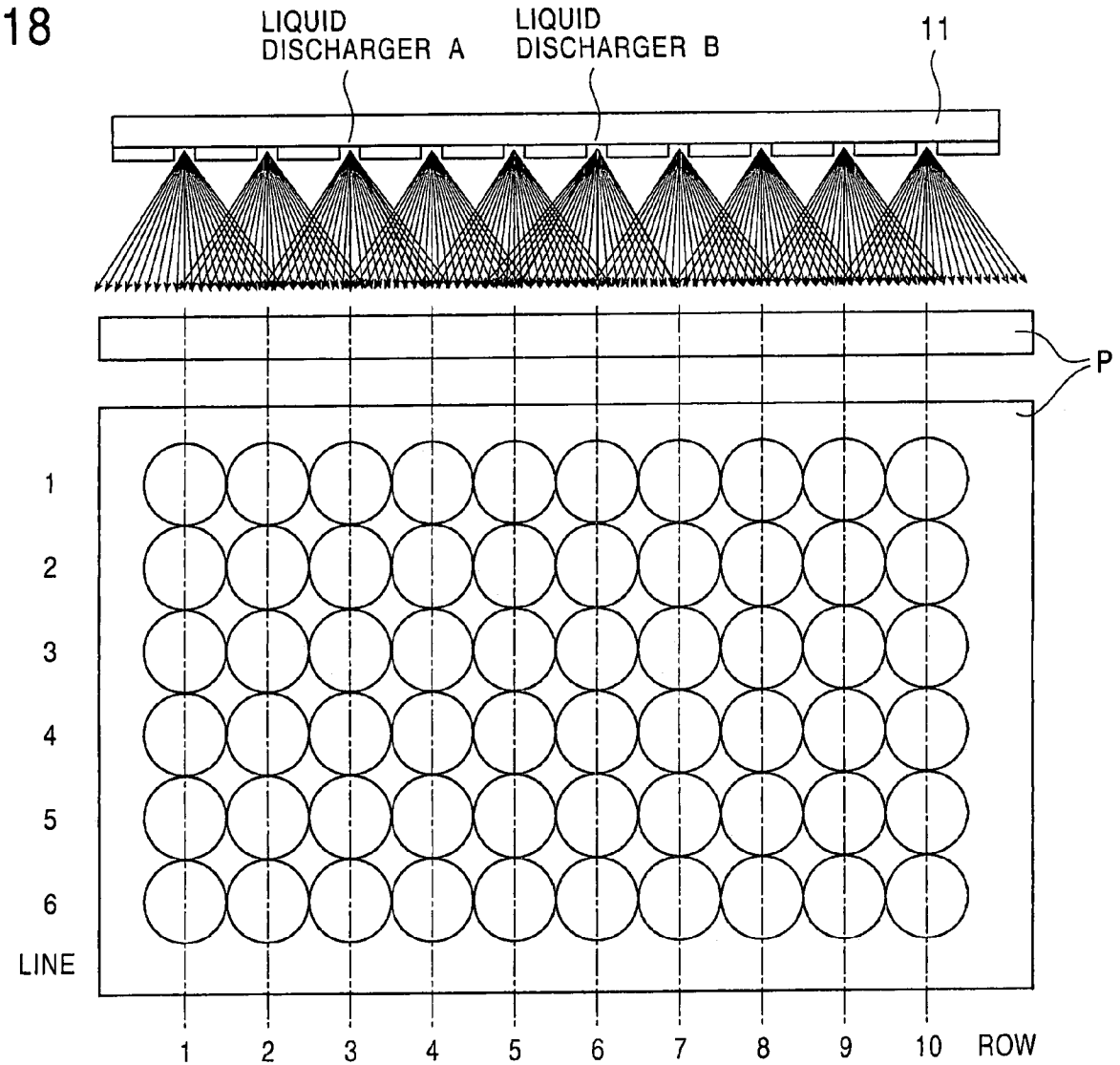
FIG. 18 illustrates liquid dischargers having a discharge-direction changing unit and a reference-direction setting unit combined with a first discharge controlling unit.

FIG. 18 illustrates the combination of (1) in the above wherein a discharge-direction changing unit and a reference-direction setting unit are combined with a first discharge controlling unit.

In FIG. 18, a liquid discharger A discharges an ink droplet onto a pixel area at the second row of the first line (i.e., the pixel area left of the pixel area on the third row, directly below the liquid discharger A). Next, in the second line, an ink droplet is discharged onto a pixel area in the third row, directly below the liquid discharger A.

Next, in the third line, an ink droplet is discharged onto the pixel area in the fourth row (i.e., the pixel area right of the pixel area on the third row, directly below the liquid discharger A). In the fourth line, an ink droplet is discharged in the same way as in the first line. In this way, every liquid discharger discharges ink droplets onto pixel rows adjacent to the pixel row directly below the liquid discharger.

Figure 19:
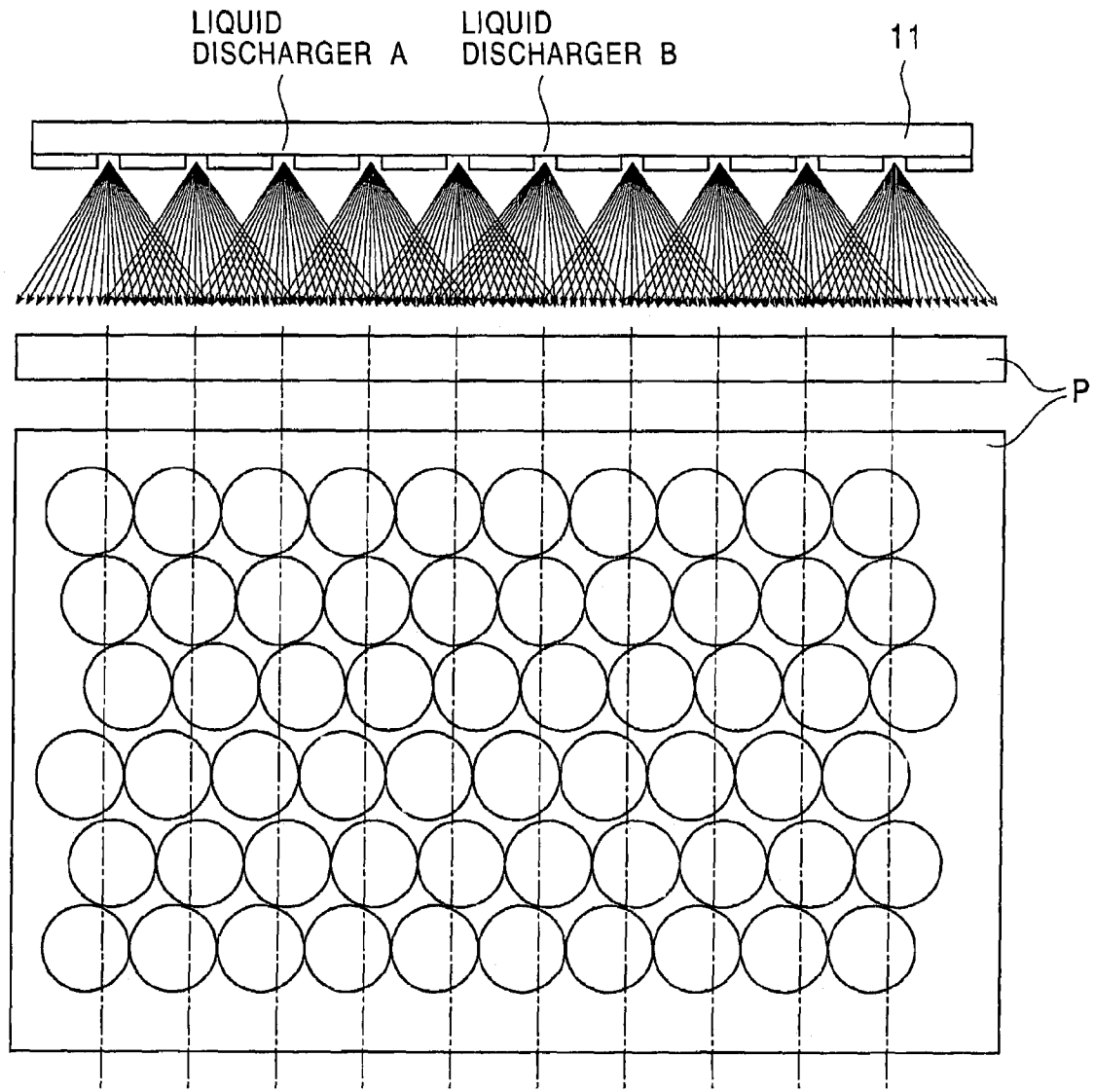
FIG. 19 illustrates liquid dischargers having a discharge-direction changing unit and a reference-direction setting unit combined with a first discharge controlling unit and a second discharge controlling unit.

FIG. 19 illustrates the combination of (3) in the above wherein a discharge-direction changing unit and a reference-direction setting unit are combined with a first discharge controlling unit and a second discharge controlling unit.

In other words, liquid dischargers having this combination discharge ink droplets in the same way as in FIG. 18 while, in addition, the landing positions of the ink droplets are randomly allotted within the same pixel areas.

Figure 20:
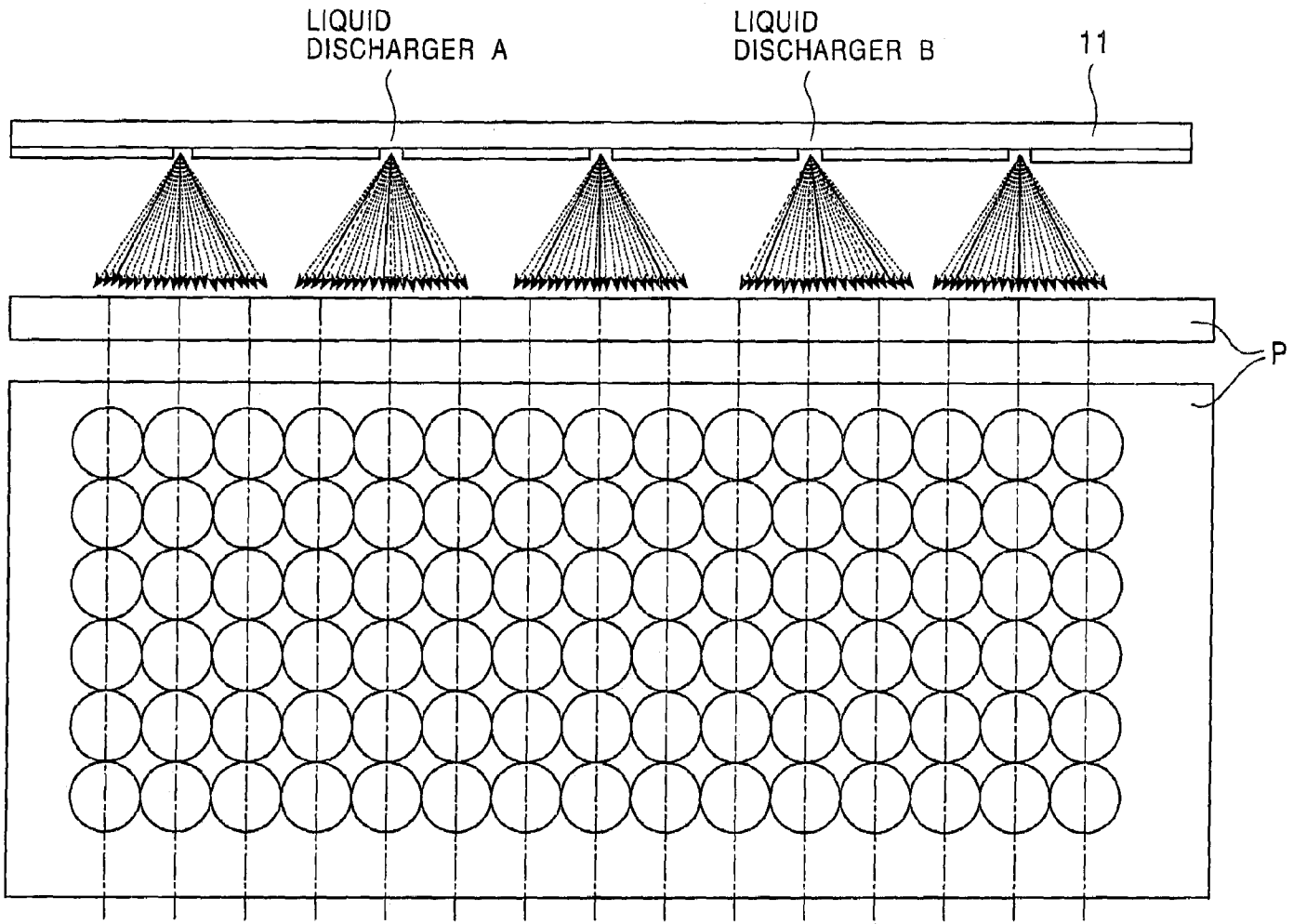
FIG. 20 illustrates liquid dischargers having a discharge-direction changing unit and a reference-direction setting unit combined with a resolution increasing unit.

FIG. 20 illustrates the combination of (4) in the above wherein a discharge-direction changing unit and a reference-direction setting unit are combined with a resolution increasing unit.

In other words, similar to FIG. 6, discharge-direction changing units enable each liquid discharger to discharge ink droplets along a plurality of trajectories and a reference direction selects one of the trajectories as a reference trajectory. Unlike the other liquid dischargers, the reference trajectories for liquid dischargers A and B are not the trajectories in the middle of the plurality of trajectories.

The resolution increasing unit increases the resolution of each liquid discharger to three times the structural resolution of the head 11 by enabling the liquid dischargers to discharge ink droplets onto a pixel row directly below the liquid dischargers in addition to the pixel rows on the left and right of the pixel row directly below the liquid discharger.

A discharge controlling circuit that is a realization of the embodiments according to the present invention is described in the following.

In this embodiment, a secondary controlling unit uses a discharge controlling circuit to supply energy to heat-generating-resistors 13. This energy is different from the energy supplied by a main controlling unit to the heat-generating-resistors 13. In this way, the discharge controlling circuit controls a liquid discharger to discharge droplets along a trajectory that is different from the trajectory controlled by the main controlling unit.

More specifically, the secondary controlling unit includes a circuit (in the following the circuit is a current mirror circuit) having a switching element connected between the two serially connected parts of the heat-generating-resistor 13 disposed inside an ink chamber 12. By letting an electrical current flow into or flow out from the connection between the two parts of the heat-generating-resistor 13 via the circuit, the electrical current supplied to each part of the heat-generating-resistor 13 can be controlled. In this way, the trajectory of the ink droplets discharged from a liquid discharger controlled by the circuit differs from the trajectory of the ink droplets discharged from a liquid discharger controlled by the main controlling unit.

Figure 21:
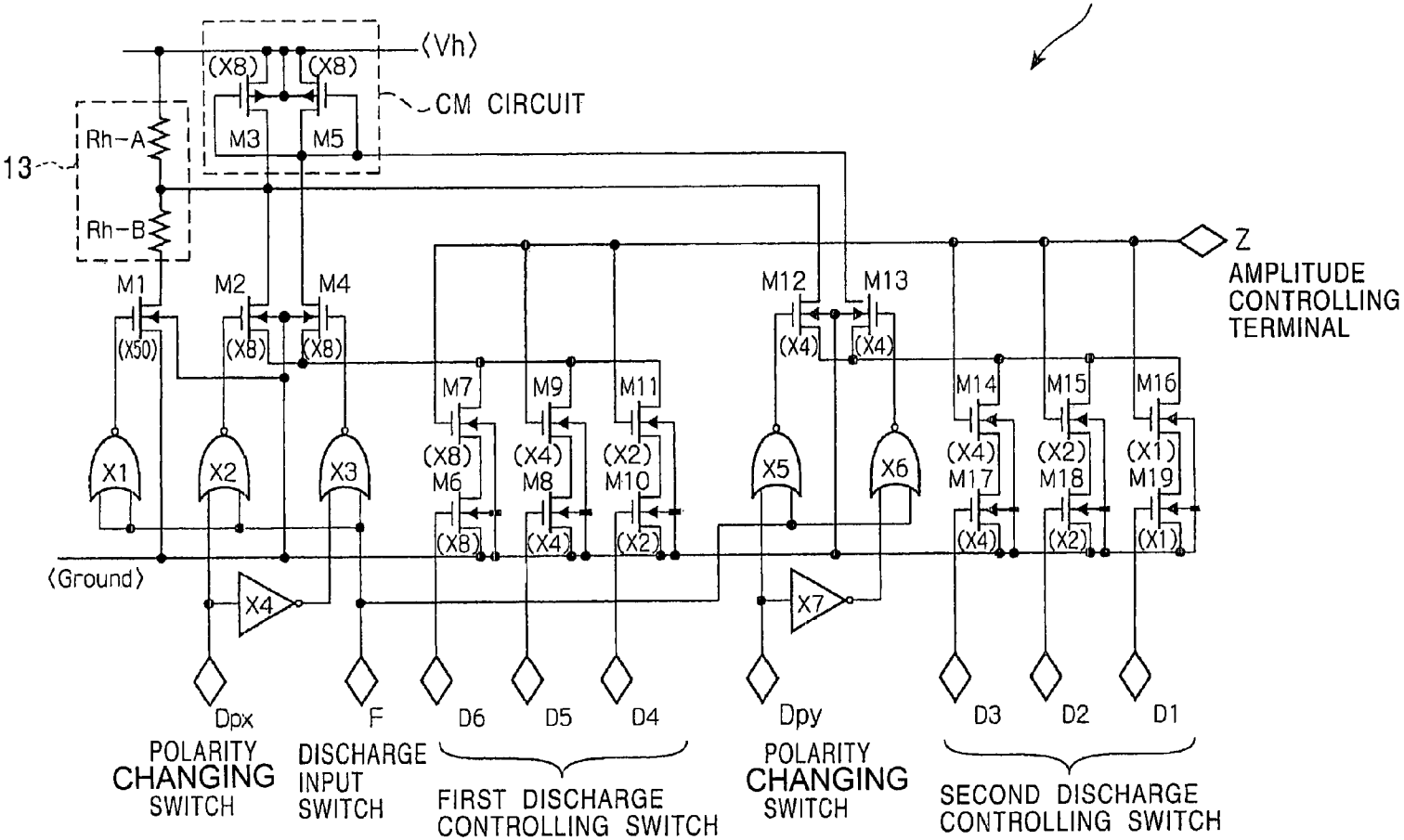
FIG. 21 illustrates a discharge controlling circuit according to an embodiment of the present invention.

FIG. 21 illustrates a discharge controlling circuit 50 according to this embodiment.

Each of the resistors Rh-A and Rh-B of the discharge controlling circuit 50 are the two parts of a heat-generating-resistor 13 contained inside an ink chamber 12. The resistors Rh-A and Rh-B are connected serially. The resistance of each part of the heat-generating-resistor 13 is substantially the same. Thus, by supplying the same electrical current to each part of the heat-generating-resistor 13, ink droplets can be discharged without any deflection from a nozzle 18 (in the direction indicated by a dotted arrow in FIG. 5).

A current mirror circuit (hereinafter referred to as the 'CM circuit') is connected between the two serially connected parts of the heat-generating-resistor 13. By letting an electrical current flow into or flow out from the connection between the two parts of the heat-generating-resistor 13 via the CM circuit, the electrical current supplied to each part differs. This difference enables ink droplets to be discharged from a nozzle 18 (i.e., a liquid discharger) along a plurality of trajectories in the alignment direction of the nozzles 18 (i.e., along the row of the nozzles 18).

A power source Vh is connected for supplying voltage to the resistors Rh-A and Rh-B. The discharge controlling circuit 50 has transistors M1 to M19. The numbers "×N (where N=1, 2, 4, 8, or 50)" written in parentheses below each transistor M1 to M19 in FIG. 21 indicate the number of elements connected in parallel. For example, "×1" (which is written in parentheses below transistors M16 and M19) indicates that the transistor has one standard element. Similarly, "×2" indicates that the transistor has an element equivalent to two standard elements connected in parallel. In the same way, "×N" indicates that the transistor has an element equivalent to N elements connected in parallel.

The transistor M1 functions as a switching element for turning on or off the electrical supply to the resistors Rh-A and Rh-B. A drain of the transistor M1 is serially connected to the resistor Rh-B. When "0" is input to a discharge input switch F, the transistor M1 is turned on and an electrical current is supplied to the resistors Rh-A and Rh-B. In this embodiment, as a matter of convenience for the IC design of the circuit, the discharge input switch F is a negative logic and "0" is input only when the transistor M1 is driven (i.e., only when ink droplets are discharged). When "0" is input to the discharge input switch F, the input values to a NOR gate X1 are (0, 0). Thus, the output is "1," and the transistor M1 is turned on.

In this embodiment, to discharge ink droplets from a nozzle 18, the discharge input switch F is turned on ("0" is input) for only 1.5 μs (1/64), and then, an electrical current is supplied to the resistors Rh-A and Rh-B from the power source Vh (about 9V). For 94.5 μs (63/64), the discharge input switch F is turned off ("1" is input). During this time period, ink is supplied to the ink chamber 12 of the liquid discharger that has discharged an ink droplet.

Polarity changing switches Dpx and Dpy are switches for determining whether or not the trajectory of the ink droplet to be discharged would be deflected leftwards of rightwards along the alignment direction (the horizontal direction) of the nozzles 18.

First discharge controlling switches D4, D5, and D6 and second discharge controlling switches D1, D2, and D3 are switches for determining the amplitude of the deflection of the trajectory of an ink droplet.

Each pair of transistors M2 and M4 and transistors M12 and M13 functions as an operational amplifier (a switching element) for the CM circuit composed of the transistors M3 and M5. More specifically, the pairs of transistors M2 and M4 and transistors M12 and M13 supply an electrical current to or receive an electrical current from the connection between the resistors Rh-A and Rh-B.

The combinations of transistors M7, M9, and M11 and transistors M14, M15, and M16 are elements that function as constant current sources for the CM circuit. The drains for transistors M7, M9, and M11 are connected to the source and the backgate of the transistors M2 and M4. Similarly, the drains of the transistors M14, M15, and M16 are connected to the source and the backgate of the transistors M12 and M13.

Among the transistors that function as constant current source elements, the capacity of the transistor M7 is "×8," the capacity of the transistor M9 is "×4," and the capacity of the transistor M11 is "×2." These three transistors M7, M9, and M11 are connected serially to form a group of current source elements.

Similarly, the capacity of the transistor M14 is "×4," the capacity of the transistor M15 is "×2," and the capacity of the transistor M16 is "×1." These three transistors M14, M15, and M16 are also connected serially to form a group of current source elements.

The transistors M7, M9, and M11 and transistors M14, M15, and M16 that function as current source elements are connected to transistors having the same current capacity (i.e., the transistors M6, M8, and M10 and transistors M17, M18, and M19, respectively). The first discharge controlling switches D6, D5, and D4 are connected to transistors M6, M8, and M10, respectively, and the second discharge controlling switches D3, D2, and D1 are connected to transistors M17, M18, and M19, respectively.

Therefore, for example, turning on the first discharge controlling switches D6 and applying an appropriate voltage (Vx) to the connection between an amplitude controlling terminal Z and the ground turns on the transistor M6 and supplies a current caused by the voltage Vx to the transistor M7.

Consequently, by controlling the on and off states of the first discharge controlling switches D4 to D6 and the second discharge controlling switches D1 to D3, the on and off states of the transistors M6 to M11 and transistors M14 to M19 can be controlled.

Since the number of serially connected elements for the transistors M7, M9, and M11 and the transistors M14, M15, and M16 are different, electrical currents are supplied from the transistor M2 to the transistors M7, M9, and M11 and from the transistor M12 to the transistors M14, M15, and M16 at a proportion corresponding to the number indicated in the parentheses in FIG. 21.

Since the proportions of the transistors M7, M9, and M11 are "×8," "×4," and "×2," respectively, the ratio of their drain current Id is 8:4:2. Similarly, since the proportions of the transistors M14, M15, and M16 are "×4," "×2," and "×1," respectively, the ratio of their drain current Id is 4:2:1.

The flow of an electrical current in the first discharge controlling switches D4 to D6 of the discharge controlling circuit 50 is described referring to FIG. 21.

First, when the discharge input switch F outputs "0" (i.e., discharge input switch F is turned on) and the polarity changing switch Dpx outputs "0," the values (0, 0) are sent to the NOR gate X1, and then "1" is output to turn on the transistor M1. Similarly, the values (0, 0) are sent to a NOR gate X2, and then "1" is output to turn on the transistor M2. Moreover, in the case above where the input to the discharge input switch F is "0" and the input to the polarity changing switch Dpx is "0", "0" is output from the discharge input switch F and "1" is output from a NOT gate X4, which receives "0" from the polarity changing switch Dpx. As a result, the values (1, 0) are sent to a NOR gate X3. Consequently, "0" is output from the NOR gate X3 and the transistor M4 is turned off.

In such a case, an electrical current flows out from the transistor M3 into the transistor M2 since the transistor M2 is turned on but an electrical current does not flow out from the transistor M5 into the transistor M4 since the transistor M4 is turned off. Due to the characteristic of the CM circuit, when an electrical current is not supplied to the transistor M5, an electrical current is also not supplied to the transistor M3.

If a voltage from the power source Vh is applied, an electrical current is not supplied to the transistors M3 and M5 because the transistors M3 and M5 are turned off. Accordingly, the electrical current does not flow any further than the transistors M3 and M5 and the electrical current is supplied entirely to the resistor Rh-A. Since the transistor M2 is turned on, the electrical current supplied to the resistor Rh-A flows further to the transistor M2 and the resistor Rh-B. In this way, the electrical current can be supplied further beyond the transistor M2. In such a case, when the first discharge controlling switches D4, D5, and D6 are turned off, an electrical current is not supplied to the transistors M7, M9, and M11. Resultingly, an electrical current is not supplied to the transistor M2. Thus, the electrical current supplied entirely to the resistor Rh-A is supplied to the resistor Rh-B. Moreover, the electrical current supplied to the resistor Rh-B is sent to a ground after it flows through the turned-on transistor M1.

Contrarily, when at least one of the first discharge controlling switches D4 to D6 is turned on, the transistor M6, M8, or M10 that corresponds to the turned-on first discharge controlling switches D4 to D6 is turned on. One of the transistors M7, M9, and M11 connected to one of the corresponding transistors M6, M8, and M10 is also turned on.

As a result, for example, when the first discharge controlling switch D6 is turned on, the electrical current that has flowed through the resistor Rh-A flows into the transistor M2 and the resistor Rh-B. Then the electrical current that has flowed through the transistor M2 is sent to the ground via the transistors M7 and M6.

In other words, provided that the discharge input switch F outputs "0" and the polarity changing switch Dpx outputs "0," when at least one of the first discharge controlling switches D4 to D6 is turned on, an electrical current does not flow into the transistors M3 and M5 and is entirely supplied to the resistor Rh-A. Then the electrical current flows into the transistor M2 and the resistor Rh-B.

Consequently, the electrical current I supplied to the resistors Rh-A and Rh-B is I(Rh-A)>I(Rh-B). (Note that the expression I(Rh-A) represents the electrical current I supplied to (Rh-A), and the expression I(Rh-B) represents the electrical current I supplied to (Rh-B)).

On the other hand, when the discharge input switch F outputs "0" and the polarity changing switch Dpx outputs "1," the values input to the NOR gate X1 are (0, 0), the same as in the case above, and then "1" is output to turn on the transistor M1.

The values (1, 0) are sent to a NOR gate X2, and then "0" is output to turn off the transistor M2. Moreover, the values (0, 0) are sent to a NOR gate X3, and then "1" is output to turn on the transistor M4. Due to the characteristic of the CM circuit, when an electrical current is supplied to the transistor M5, an electrical current is also supplied to the transistor M3.

When a voltage from the power supply Vh is applied, an electrical current is supplied to the resistor Rh-A and the transistors M3 and M5. The electrical current that flows through the resistor Rh-A is supplied entirely to the resistor Rh-B (since the transistor M2 is turned off and the electrical current that flows out of the resistor Rh-A does not flow into the transistor M2). The electrical current that flows through the transistor M3 is supplied entirely to the resistor Rh-B since the transistor M2 is turned off.

Consequently, the resistor Rh-B receives, in addition to the electrical current that has flowed through the resistor Rh-A, the electrical current that has flowed through the transistor M3. As a result, the electrical current I that is supplied to the resistors Rh-A and Rh-B is I(Rh-A)<I (Rh-B).

In the case described above, for an electrical current to be supplied to the transistor M5, the transistor M4 has to be turned on. The transistor M4 is turned on when, as described above, "0" is input to the discharge input switch F and "1" is input to the polarity changing switch Dpx.

For an electrical current to be supplied to the transistor M4, at least one of the transistors M7, M9, and M11 has to be turned on. Thus, similar to the case in which "0" is input to-the discharge input switch F and "0" is input to the polarity changing switch Dpx, at least one of the first discharge controlling switches D4 to D6 has to be turned on. In other words, when the first discharge controlling switches D4 to D6 are all turned off, the outputs are the same for both when "0" is input to the discharge input switch F, "1" is input to the polarity changing switch Dpx, "0" is input to the discharge input switch F and "0" is input to the polarity changing switch Dpx. Thus, the electrical current supplied to the resistor Rh-A is supplied entirely to the resistor Rh-B. If the resistances of the resistors Rh-A and Rh-B are set substantially the same, an ink droplet is discharged without any deflection.

As described in the above, by turning on the discharge input switch F and by controlling the on and off states of the polarity changing switch Dpx and the first discharge controlling switches D4 to D6, an electrical current flows into or flows out from the connection between the resistors Rh-A and Rh-B.

Since the capacity of each transistor M7, M9, and M11 that functions as a current source element are different, the electrical current supplied from the transistors M2 and M4 can be changed by controlling the on and off states of the first discharge controlling switches D4 to D6. In other words, by controlling the on and off states of the first discharge controlling switches D4 to D6, the values of the electrical currents supplied to the resistors Rh-A and Rh-B can be changed.

Thus, by applying an appropriate voltage Vx to the connection between the amplitude controlling terminal Z and the ground and independently operating the polarity changing switch Dpx and the first discharge controlling switches D4, D5, and D6, the landing positions of the ink droplets discharged from each liquid discharger can be changed in multiple steps in the alignment direction of the nozzles 18.

By changing the voltage Vx applied to the amplitude changing terminal Z, the amplitude of the deflection of the trajectory of the ink droplets can be changed for each step, while maintaining the ratio of the drain currents supplied to the transistors M7 and M6, the transistors M9 and M8, and the transistors M11 and M10 as 8:4:2.

FIGS. 22A and 22B are charts indicating the on and off states of the polarity changing switch Dpx and the first discharge controlling switches D4 to D6 and the change in the landing positions of dots (ink droplets) in the alignment direction of the nozzles 18.

As shown in the chart in FIG. 22A, when the input to the first discharge controlling switch D4 is set to "0" and when the input values (Dpx, D6, D5, D4) are (0, 0, 0, 0) or (1, 0, 0, 0), the trajectory of the dot is not deflected and the landing position is directly below the nozzle 18. This corresponds to the description above.

When the input to the first discharge controlling switch D4 is set to "0," a liquid discharger can be controlled by the three bits from the polarity changing switch Dpx and the first discharge controlling switches D5 and D6. In this way, a dot can be landed stepwise at seven landing positions including an undeflected position. This means the trajectory of an ink droplet can be selected from an odd number of trajectories, as shown in, for example, FIG. 11.

Instead of setting the input value of the first discharge controlling switch D4 to "0," by selecting "0" or "1" as the input value in the same way as the first discharge controlling switches D5 and D6, the trajectory of the ink droplet can be selected from 15 different trajectories instead of seven trajectories.

Contrarily, as shown in the chart in FIG. 22B, when the input value of the first discharge controlling switch D4 is set to "1," a dot can be landed stepwise at eight landing positions. In this way, eight landing positions can be arranged symmetrically by disposing four landing positions each on the left and right sides of the position with zero deflection.

In other words, when the input value of the first discharge controlling switch D4 is "1," there are no landing positions located directly below a nozzle 18. This means the trajectory of an ink droplet can be selected from an even number of trajectories (not including a trajectory in which the ink droplet lands directly below a nozzle 18), as shown in, for example, FIG. 10.

The descriptions in the above are related to the first discharge controlling switches D4 to D6. The second discharge controlling switches D1 to D3 can also be controlled in the same manner.

In FIG. 21, the second discharge controlling switches D1, D2, and D3 correspond to the first discharge controlling switches D4, D5, and D6, respectively. The transistors M12 and M13 connected to the second discharge controlling switches D1 to D3 correspond to the transistors M2 and M4 of the first discharge controlling switches D4 to D6. The polarity changing switch Dpy corresponds to the polarity changing switch Dpx. The transistors M14 to M19 that function as current source elements correspond to the transistors M6 to M11.

The capacity of each transistor M14 to M19 that functions as a current source element of the second discharge controlling switches D1 to D3 differs from the transistors M6 to M11 of the first discharge controlling switches D4 to D6. The transistors M14 to M19 that function as current source elements of the second discharge controlling switches D1 to D3 are set so that the capacity is half of that of the transistors M6 to M11 of the first discharge controlling switches D4 to D6. The other settings are the same for all transistors.

Therefore, similar to the description in the above, by controlling the on and off states of the second discharge controlling switches D1 to D3 together with the polarity changing switch Dpy, the electrical current supplied to the resistors Rh-A and Rh-B can be changed.

The change in the electrical current caused by controlling the second discharge controlling switches D1 to D3 is smaller than the change caused by the first discharge controlling switches D4 to D6. Thus, the variation in pitch of the landing positions of the ink droplets controlled by the second discharge controlling switches D1 to D3 is smaller than the variation in pitch of the landing positions of the ink droplets controlled by the first discharge controlling switches D4 to D6.

The second discharge controlling switches D1 to D3 and the polarity changing switch Dpy are mainly used for the second discharge controlling unit. Thus, it is possible to control them as indicated in the chart in FIG. 22B. In FIGS. 22A and 22B, the polarity changing switch Dpx and the first discharge controlling switches D4, D5, and D6 correspond to polarity changing switch Dpy and the second discharge controlling switches D1, D2, and D3, respectively. In this case, it is desirable to set the input value for the second discharge controlling switch D1 to "1." (Of course, it is perfectly acceptable to control the switches in accordance with the chart in FIG. 22A).

The same amplitude controlling terminal Z of the discharge controlling circuit 50 illustrated in FIG. 21 is used for both the first discharge controlling switches D4 to D6 and the second discharge controlling switches D1 to D3. Therefore, once the voltage Vx applied to the amplitude controlling terminal Z is determined by taking into consideration, for example, the control of the second discharge controlling switches D1 to D3, the landing position of an ink droplet whose discharge is controlled by the first discharge controlling switches D4 to D6 is also determined by the voltage Vx.

In this way, a relationship is established between the discharge controls by the first discharge controlling switches D4 to D6 and the second discharge controlling switches D1 to D3. Consequently, by determining the discharge control (i.e., the pitch of the landing position of the ink droplet) for either the first or second discharge controlling switches, the discharge control (i.e., the pitch of the landing position of the ink droplet) for the other switches is determined.

In this way, the control of the ink droplet discharge can be simplified.

Unlike the structure described above, two amplitude controlling terminals Z for the first discharge controlling switches D4 to D6 and the second discharge controlling switches D1 to D3 may be independently disposed. In this way, the number of the trajectories (landing positions) of the ink droplets can be increased.

Each liquid discharger has the discharge controlling circuit 50 illustrated in FIG. 21. Therefore, each liquid discharger can be controlled as described in the above.

When a transistor is included in the circuit, eight wires are required for the drain, the source, and other parts. For this reason, the total size required for the transistors is much smaller when one large transistor with eight wires is disposed rather than when a plurality of small transistors each with eight wires is disposed. Thus, the entire circuit can be simplified by disposing one CM circuit (a pair of transistors M3 and M5) having a capacity of "×8," as shown in FIG. 21.

In this way, liquid dischargers each having the discharge controlling circuit 50 can be disposed on the head 11. Moreover, the discharge controlling circuits 50 can be disposed even if the resolution is 600 dpi (i.e., even if the pitch of the liquid dischargers is about 42.3 μm).

Consequently, by disposing a discharge controlling circuit 50 for each liquid discharger and by controlling the on and off states of each switch for each liquid discharger independently, a discharge-direction changing unit, or a main controlling unit and a secondary controlling unit can be operated. When the main controlling unit and the secondary controlling unit are operated, a secondary-control executing unit stores in its memory whether or not the secondary controlling unit for each liquid discharger is to be operated and the on or off state of each switch when the secondary controlling unit is operated. Similarly, when a discharge-direction changing unit and a reference-direction setting unit are both operated, or, in other words, when the reference direction for each liquid discharger is determined, the on or off state of each switch for each liquid discharger can be stored in memory.

By changing the voltage Vx applied to the amplitude controlling terminal Z, the amplitude of the trajectory (i.e., discharge angle) for each step can be changed. Consequently, when the discharge-angle setting unit is operated, the voltage Vx applied to the amplitude controlling terminal Z of each liquid discharger can be adjusted to set a desired discharge angle. The value of the voltage Vx can be stored in memory.

The first discharge controlling unit is operated by controlling the on and off states of the first discharge controlling switches D4 to D6. The second discharge controlling unit is operated by controlling the on and off states of the second discharge controlling switches D1 to D3.

The first discharge controlling switches D4 to D6 in FIG. 21 can also be used as a resolution increasing unit. When the first discharge controlling switches D4 to D6 are also used as the resolution increasing unit, it is desirable to change the output of each first discharge controlling switch D4 to D6 to "0" or "1" so that the trajectory of an ink droplet is selected from 15 different trajectories. In other words, for example, when the resolution is increased by three times, as illustrated in FIG. 15, and when the ink droplets are discharged from a liquid discharger to land on pixel rows formed by adjacent liquid dischargers, as illustrated in FIG. 11, the trajectories of the ink droplets must be selected from at least nine different trajectories.

Of course, the first discharge controlling switches D4 to D6 and the second discharge controlling switches D1 to D3 can be connected in parallel and the discharge controlling switches, polarity changing switches, and the transistors for the resolution increasing unit can be formed separately.

An embodiment according to the present invention has been described in the above. The present invention, however, is not limited to this, and various embodiments, as described below, are also possible.

(1) The number of bits for a J-bit controlling signal is not limited to those indicated in the embodiments above and any bit may be used for the present invention.

(2) In the embodiments described in the above, a time lag is created in the ink boiling (bubble generation) time of each of the two parts of a heat-generating-resistor 13 by changing the electrical current supplied to each of the parts. The heat-generating-resistor of the present invention may have two parts aligned in parallel having the same resistance, and electrical currents may be supplied at different timings to each part. For example, the two parts of the heat-generating-resistor may each have a switch that operates independently from each other. By turning on each switch at a different timing, a time lag is created in the bubble generation time of the two parts of a heat-generating-resistor. Furthermore, a time lag is created in the timing of supplying electrical currents to each part of the heat-generating-resistor, at the same time the current value of the electrical currents is changed.

(3) In the embodiments described above, each of the two parts of the heat-generating-resistor 13 is aligned in parallel inside one ink chamber 12. The reason for dividing the heat-generating-resistor 13 into two parts is that the two parts are known to have sufficient durability and the structure of the circuit can be simplified. The present invention, however, is not limited to this, and the heat-generating-resistor (energy generation element) may be divided into three parts or more, and these parts may be aligned in parallel in one ink chamber.

(4) In the embodiments described above, the heat-generating-resistor 13 is used as a bubble generation unit or a heating element. The bubble generation unit or heating element for the present invention, however, does not have to be a resistor. Moreover, an energy generation element other than a heating element may be used. For example, an electrostatic or piezoelectric energy generation element may be used.

An electrostatic energy generation element is composed of a diaphragm and two electrodes disposed on the lower side of the diaphragm with a layer of air interposed between the diaphragm and electrodes. A voltage is applied between the two electrodes to bend the diaphragm downwards. Then, the voltage is reduced to zero to release the electrostatic force. The elastic force generated when the diaphragm returns to its original position is used to discharge an ink droplet.

In this case, for example, to create a difference in the energy generated by each energizing element, a time lag is created between the two energizing elements or different voltages are applied to each energizing element when the diaphragm is returned to its original position (when the voltage is reduced to zero and the electrostatic force is released).

The energizing element for a piezoelectric printer is formed by stacking a diaphragm and a piezoelectric element having electrodes on both sides. When a voltage is applied to the electrodes on both sides of the piezoelectric element, a bending moment is generated in the diaphragm due to the piezoelectric effect. As a result, the diaphragm bends and is deformed. Ink droplets are discharged when this deformation occurs.

In this case, similar to the above, to create a difference in the energy generated by each energizing element, a time lag is created between the two energizing elements or different voltages are applied to each energizing element.

(5) In the embodiments described above, ink droplets are discharged in the alignment direction of the nozzles 18. This is because the two parts of the heat-generating-resistor 13 are aligned in parallel in the alignment direction of the nozzles 18. The alignment direction of the nozzles 18 and the deflection direction of the ink droplets do not necessarily have to be the same direction. Even if the directions are somewhat different, the effect is substantially the same as when the alignment direction of the nozzles 18 and the deflection direction of the ink droplets are the same.

(6) When ink droplets are randomly discharged onto an M number of landing positions in one pixel area by operating the second discharge controlling unit, M may be any number, provided that it is a positive integer greater or equal to two. Thus, M is not limited to the numbers indicated in the embodiments described above.

(7) The second discharge controlling unit according to the embodiments of the present invention randomly changes the landing positions of the ink droplets so that the center of the ink droplets lands inside a pixel area. The present invention, however, is not limited to this, and the landing positions of the ink droplets may be dispersed over a wider range compared to the embodiments described above, provided that at least a part of the ink droplet lands inside a pixel area.

(8) The second discharge controlling unit according to the embodiments of the present invention uses a random number generating circuit for randomly selecting the landing positions of the ink droplets. Any method may be used for determining the landing positions of the ink droplets, provided that the landing positions have no regular pattern. Moreover, random numbers may be generated by applying, for example, the middle square method, or the congruence method, or by using a shift resister. Instead of selecting the landing positions randomly, they may be selected by repeating a predetermined combination of numeric values.

(9) In the embodiments described in the above, the heads 11 were used for a printer. The application of the heads 11 according to the present invention, however, is not limited to printers, and may be used for various liquid discharge apparatuses. For example, the heads may be used for an apparatus for discharging a solution including DNA for detecting biological specimens.

According to the present invention, even if some of the liquid dischargers discharge droplets along different trajectories (or different discharge angles), the trajectories are compensated for and, as a result, streaks become less noticeable.

What is claimed is:

1. A liquid discharge apparatus having a head with a plurality of liquid dischargers and nozzles with a respective one of the plurality of nozzles operably associated a respective one of the liquid dischargers, the plurality of liquid dischargers and nozzles being aligned in a row, each one of the plurality of liquid dischargers defining an ink chamber, the liquid discharge apparatus, comprising:

a main controlling unit formed on each liquid discharger, the main controlling unit controlling the discharge of droplets from the nozzles;

a secondary controlling unit formed on each liquid discharger, the secondary controlling unit controlling the discharge of a droplet so that the droplet is discharged along at least one secondary direction different from a main direction of the droplets discharged by said each liquid discharger controlled by the main controlling unit;

a secondary-control executing unit for individually setting whether or not the secondary controlling unit for each liquid discharger is operated; and a plurality of heat-generating resistor assemblies, each heat-generating resistor assembly including a pair of heat-generating resistors, a respective one of the plurality of heat-generating resistor assemblies being disposed in a respective chamber, wherein the main controlling unit is operative to individually control an amount of heat of the heat-generating resistors of each one of the plurality of heat-generating resistor assemblies, the amount of heat generated in one heat-generating resistor of at least one pair of the heat-generating resistors being different than a remaining one of the at least one pair of the heat-generating resistors.

2. A liquid discharge apparatus according to claim 1 having a plurality of liquid dischargers comprising a liquid chamber containing liquid, bubble generation units disposed inside the liquid chamber for generating bubbles in the liquid contained in the liquid chamber by supplying energy, and a nozzle member provided with nozzles for discharging the liquid contained in the liquid chamber in response to generation of bubbles by the bubble generation units, wherein a secondary controlling unit controls the at least one secondary direction of a droplet discharged by supplying energy having a second value to the bubble generation units, the second value differs from a first value of the energy supplied to the bubble generation units by the main controlling unit, so that the at least one secondary direction of the droplet differs from the main direction of the droplet controlled by the main controlling unit.

3. A liquid discharge apparatus according to claim 1 having a plurality of liquid dischargers comprising a liquid chamber containing liquid, heating elements disposed in the liquid chamber for generating a bubble in the liquid contained in the liquid chamber by supplying energy, and a nozzle member provided with nozzles for discharging the liquid contained in the liquid chamber as a bubble is generated by the heating elements, wherein a plurality of heating elements is aligned in parallel in a row in the liquid chamber and each heating element is serially connected, and the secondary controlling unit includes a circuit with a switching element connected to the serial connection between the heating elements and controls the at least one secondary direction of a droplet by supplying an electrical current via the circuit to the connection between the heating elements or by receiving an electrical current from the connection to the heating elements to control the electrical current supplied to the heating elements, so that the secondary direction differs from the main direction controlled by the main controlling unit.

4. A liquid discharge apparatus having a head with a plurality of liquid dischargers and nozzles with a respective one of the plurality of nozzles operably associated a respective one of the liquid dischargers, the plurality of liquid dischargers and nozzles being aligned in a row, each one of the plurality of liquid dischargers defining an ink chamber, the liquid discharge apparatus, comprising:

a discharge-direction changing unit for changing a direction of a droplet discharged from the nozzle of each liquid discharger in at least two different directions in the row;

a reference-direction setting unit for individually selecting for said each liquid discharger one of the directions of the droplet discharged from said each liquid discharger, controlled by the discharge-direction changing unit, as a reference direction; and a plurality of heat-generating resistor assemblies, each heat-generating resistor assembly including a pair of heat-generating resistors, a respective one of the plurality of heat-generating resistor assemblies being disposed in a respective chamber, wherein the discharge-direction changing unit is operative to change the direction of the droplet discharged from the nozzle by individually controlling an amount of heat of the heat-generating resistors of each one of the plurality of heat-generating resistor assemblies, the amount of heat generated in one heat-generating resistor of at least one pair of the heat-generating resistors being different than a remaining one of the at least one pair of the heat-generating resistors.

5. A liquid discharge apparatus having a head with a plurality of liquid dischargers and nozzles with a respective one of the plurality of nozzles operably associated a respective one of the liquid dischargers, the plurality of liquid dischargers and nozzles being aligned in a row, each one of the plurality of liquid dischargers defining an ink chamber, the liquid discharge apparatus, comprising:

a discharge-direction changing unit for changing a direction of a droplet discharged from the nozzle of each liquid discharger in at least two different directions in the row;

a discharge-angle setting unit for individually selecting for said each liquid discharger discharge angles for said droplet discharged from said each liquid discharger, controlled by the discharge-direction changing unit; and a plurality of heat-generating resistor assemblies, each heat-generating resistor assembly including a pair of heat-generating resistors, a respective one of the plurality of heat-generating resistor assemblies being disposed in a respective chamber, wherein the discharge-direction changing unit is operative to change the direction of the droplet discharged from the nozzle by individually controlling an amount of heat of the heat-generating resistors of each one of the plurality of heat-generating resistor assemblies, the amount of heat generated in one heat-generating resistor of at least one pair of the heat-generating resistors being different than a remaining one of the at least one pair of the heat-generating resistors.

6. A liquid discharge apparatus having a head with a plurality of liquid dischargers and nozzles with a respective one of the plurality of nozzles operably associated a respective one of the liquid dischargers, the plurality of liquid dischargers and nozzles being aligned in a row, each one of the plurality of liquid dischargers defining an ink chamber, the liquid discharge apparatus, comprising:

a discharge-direction changing unit for changing a direction of a droplet discharged from the nozzle of each liquid discharger in at least two different directions in the row;

a discharge-angle setting unit for individually setting for said each liquid discharger discharge angles for said droplet discharged from said each liquid discharger, controlled by the discharge-direction changing unit; and a reference-direction setting unit for individually selecting for said each liquid discharger one of the directions of the droplet discharged from said each liquid discharger, controlled by the discharge-direction changing unit, as a reference direction; and a plurality of heat-generating resistor assemblies, each heat-generating resistor assembly including a pair of heat-generating resistors, a respective one of the plurality of heat-generating resistor assemblies being disposed in a respective chamber, wherein the discharge-direction changing unit is operative to change the direction of the droplet discharged from the nozzle by individually controlling an amount of heat of the heat-generating resistors of each one of the plurality of heat-generating resistor assemblies, the amount of heat generated in one heat-generating resistor of at least one pair of the heat-generating resistors being different than a remaining one of the at least one pair of the heat-generating resistors.

7. A liquid discharger according to one of claims 4 to 6, further comprising:

a discharge controlling unit for controlling discharge of ink droplets by the discharge-direction changing unit so that a pixel row or a pixel is formed by discharging droplets from at least two neighboring liquid dischargers, wherein droplets are discharged along different directions from at least two neighboring liquid dischargers to form a pixel row by landing on the same pixel row or to form a pixel by landing on a same pixel area.

8. A liquid discharger according to one of claims 4 to 6, further comprising:

a discharge controlling unit for controlling discharge of a droplet by the discharge-direction changing unit so that the droplet lands in a landing position in a pixel area, wherein the landing position is one of M (where M is an integer greater or equal to two) different landing positions aligned in a predetermined direction in the pixel area and at least a part of each of the M landing positions is included in the pixel area.

9. A liquid discharger according to one of claims 4 to 6, further comprising:

a first discharge controlling unit for controlling discharge of ink droplets by the discharge-direction changing unit so that a pixel row or a pixel is formed by discharging droplets from at least two neighboring liquid dischargers, wherein droplets are discharged along different directions from at least two neighboring liquid dischargers to form a pixel row by landing on the same pixel row or to form a pixel by landing on a same pixel area; and a second discharge controlling unit for controlling the discharge of a droplet by the discharge-direction changing unit so that the droplet lands in a landing position in a pixel area, wherein the landing position is one of M (where M is an integer greater or equal to two) different landing positions aligned in a predetermined direction in the pixel area and at least a part of each of the M landing positions is included in the pixel area.

10. A liquid discharger according to one of claims 4 to 6, further comprising:

a resolution increasing unit for increasing a number of pixels by controlling droplets discharged from each liquid discharger so that the droplets land in at least two different positions in a predetermined direction whereby the number of pixels is increased in comparison with the number of pixels formed by droplets discharged from each liquid discharger landing in one position.

11. A liquid discharger according to one of claims 4 to 6, further comprising:

a resolution increasing unit for increasing a number of pixels by controlling droplets discharged from each liquid discharger so that the droplets land in at least two different positions in a predetermined direction whereby the number of pixels increased in comparison with the number of pixels formed by droplets discharged from each liquid discharger landing in one position, and a discharge controlling unit for controlling discharge of ink droplets by the discharge-direction changing unit so that a pixel row or a pixel is formed by discharging droplets from at least two neighboring liquid dischargers, wherein each droplet is discharged along different directions from at least two neighboring liquid dischargers to form a pixel row by landing on the same pixel row or to form a pixel by landing on a same pixel area.

12. A liquid discharger according to one of claims 4 to 6, further comprising:

a resolution increasing unit for increasing a number of pixels by controlling droplets discharged from each liquid discharger so that the droplets land in at least two different positions in a predetermined direction whereby the number of pixels increased in comparison with the number of pixels formed by droplets discharged from each liquid discharger landing in one position; and a discharge controlling unit for controlling discharge of a droplet by the discharge-direction changing unit so that the droplet lands in a landing position in a pixel area, wherein the landing position is one of M (where M is an integer greater or equal to two) different landing positions aligned in a predetermined direction in the pixel area and at least a part of each of the M landing positions is included in the pixel area.

13. A liquid discharger according to one of claims 4 to 6, further comprising:

a resolution increasing unit for increasing a number of pixels by controlling droplets discharged from each liquid discharger so that the droplets land in at least two different positions in a predetermined direction whereby the number of pixels increased in comparison with the number of pixels formed by droplets discharged from each liquid discharger landing in one position;

a first discharge controlling unit for controlling discharge of ink droplets by the discharge-direction changing unit so that a pixel row or a pixel is formed by discharging droplets from at least two neighboring liquid dischargers, wherein each droplet is discharged along different directions from at least two neighboring liquid dischargers to form a pixel row by landing on the same pixel row or to form a pixel by landing on a same pixel area; and a second discharge controlling unit for controlling discharge of a droplet by the discharge-direction changing unit so that the droplet lands in a landing position in a pixel area, wherein the landing position is one of M (where M is an integer greater or equal to two) different landing positions aligned in a predetermined direction in the pixel area and at least a part of each of the M landing positions is included in the pixel area.

14. A liquid discharge apparatus according to one of claims 4 to 6 having a plurality of liquid dischargers comprising a liquid chamber containing liquid, bubble generation units disposed inside the liquid chamber for generating a bubble in the liquid contained in the liquid chamber by supplying energy, and a nozzle member provided with nozzles for discharging the liquid contained in the liquid chamber as a bubble is generated by the bubble generation units, wherein the discharge-direction changing unit comprises a main controlling unit for controlling the discharge of droplets from nozzles by supplying energy to the bubble generation units and a secondary controlling unit for controlling the direction of a droplet discharged by supplying energy having a second value to the bubble generation units, the second value differs from a first value of the energy supplied to the bubble generation units by the main controlling unit, so that the direction of the droplet differs from the direction of the droplet controlled by the main controlling unit.

15. A liquid discharge apparatus according to one of claims 4 to 6 having a plurality of liquid dischargers comprising a liquid chamber containing liquid, heating elements disposed inside the liquid chamber for generating a bubble in the liquid contained in the liquid chamber by supplying energy, and a nozzle member provided with nozzles for discharging the liquid contained in the liquid chamber as a bubble is generated by the heating elements, wherein a plurality of heating elements is aligned in parallel in a row in the liquid chamber and each heating element is serially connected, and the discharge-direction changing unit includes a circuit with a switching element connected to the serial connection between the heating elements and controls the direction of a droplet discharged from the nozzles by controlling the electrical current supplied to the heating elements by supplying an electrical current via the circuit to the connection between the heating elements or by receiving an electrical current from the connection between the heating elements, so that at least two different directions can be selected in a predetermined direction.

16. The liquid discharge apparatus according to one of claims 1 to 6, wherein said liquid dischargers are aligned in parallel in a row.

17. A method for discharging liquid from liquid dischargers, each liquid discharger having a nozzle and defining a chamber, the liquid dischargers formed on heads and aligned in a row, comprising the steps of:

providing a plurality of heat-generating resistor assemblies, each heat-generating resistor assembly including a pair of heat-generating resistors, a respective one of the plurality of heat-generating resistor assemblies being disposed in a respective chamber;

performing a main control of a discharge of droplets from the nozzle of each liquid discharger by individually controlling an amount of heat of the heat-generating resistors of each one of the plurality of heat-generating resistor assemblies, the amount of heat generated in one heat-generating resistor of at least one pair of the heat-generating resistors being different than a remaining one of the at least one pair of the heat-generating resistors;

performing a secondary control of the discharge of droplets from each liquid discharger along at least one direction different from a main direction of the main control in a row; and individually determining whether or not a secondary controlling unit is operated for each liquid discharger.

18. A method for discharging liquid from liquid dischargers, each liquid discharger having a nozzle and defining a chamber, the liquid dischargers formed on a plurality of heads and aligned in a row, comprising the steps of:

providing a plurality of heat-generating resistor assemblies, each heat-generating resistor assembly including a pair of heat-generating resistors, a respective one of the plurality of heat-generating resistor assemblies being disposed in a respective chamber;

selecting a direction of droplets discharged from the nozzle of each liquid discharger from at least two different directions in a predetermined direction;

individually selecting for said each liquid discharger one of the directions as a reference direction; and discharging the droplets from the nozzle in the selected direction by individually controlling an amount of heat of the heat-generating resistors of each one of the plurality of heat-generating resistor assemblies, the amount of heat generated in one heat-generating resistor of at least one pair of the heat-generating resistors being different than a remaining one of the at least one pair of heat-generating resistors.

19. A method for discharging liquid from liquid dischargers, each liquid discharger having a nozzle and defining a chamber, the liquid dischargers formed on a plurality of heads and aligned in a row, comprising the steps of:

providing a plurality of heat-generating resistor assemblies, each heat-generating resistor assembly including a pair of heat-generating resistors, a respective one of the plurality of heat-generating resistor assemblies being disposed in a respective chamber;

selecting a direction of droplets discharged from the nozzle of each liquid discharger from at least two different directions in a predetermined direction;

setting a discharge angle of the droplets independently for said each liquid discharger; and discharging the droplets from the nozzle in the selected direction and set discharge angle by individually controlling an amount of heat of the heat-generating resistors of each one of the plurality of heat-generating resistor assemblies, the amount of heat generated in one heat-generating resistor of at least one pair of the heat-generating resistors being different than a remaining one of the at least one pair of heat-generating resistors.

20. A method for discharging liquid from liquid dischargers, each liquid discharger having a nozzle and defining a chamber, the liquid dischargers formed on a plurality of heads and aligned in a row, comprising the steps of:

providing a plurality of heat-generating resistor assemblies, each heat-generating resistor assembly including a pair of heat-generating resistors, a respective one of the plurality of heat-generating resistor assemblies being disposed in a respective chamber;

selecting a direction of droplets discharged from the nozzle of each liquid discharger from at least two different directions in a predetermined direction;

individually selecting for said each liquid discharger one of the directions as a reference direction;

setting a discharge angle of the droplets independently for each liquid discharger; and discharging the droplets from the nozzle in the selected direction as the reference direction and set discharge angle by individually controlling an amount of heat of the heat-generating resistors of each one of the plurality of heat-generating resistor assemblies, the amount of heat generated in one heat-generating resistor of at least one pair of the heat-generating resistors being different than a remaining one of the at least one pair of heat-generating resistors.

21. The method for discharging liquid from nozzles according to one of claims 17 to 20, wherein said liquid dischargers are aligned in parallel in a row.

* * * * *